US011566809B2

(12) United States Patent
Francis et al.

(10) Patent No.: US 11,566,809 B2
(45) Date of Patent: Jan. 31, 2023

(54) OCCUPANT THERMAL COMFORT INFERENCE USING BODY SHAPE INFORMATION

(71) Applicant: Robert Bosch GmbH, Stuttgart (DE)

(72) Inventors: Jonathan Francis, Pittsburgh, PA (US); Sirajum Munir, Pittsburgh, PA (US); Matias Alberto Quintana Rosales, Singapore (SG)

(73) Assignee: Robert Bosch GmbH, Stuttgart (DE)

( * ) Notice: Subject to any disclaimer, the term of this patent is extended or adjusted under 35 U.S.C. 154(b) by 394 days.

(21) Appl. No.: 16/681,131

(22) Filed: Nov. 12, 2019

(65) Prior Publication Data

US 2021/0140671 A1 May 13, 2021

(51) Int. Cl.
*F24F 11/64* (2018.01)
*F24F 11/49* (2018.01)
*F24F 120/10* (2018.01)

(52) U.S. Cl.
CPC ..... *F24F 11/64* (2018.01); *F24F 11/49* (2018.01); *F24F 2120/10* (2018.01)

(58) Field of Classification Search
CPC ..... F24F 11/62; F24F 11/64; F24F 11/65; F24F 2120/14; F24F 2120/12; F24F 2120/10; F24F 2120/20
See application file for complete search history.

(56) References Cited

U.S. PATENT DOCUMENTS

| | | | | |
|---|---|---|---|---|
| 9,020,647 | B2 * | 4/2015 | Johnson | F24F 11/62 700/277 |
| 9,791,872 | B2 | 10/2017 | Wang et al. | |
| 10,372,990 | B2 | 8/2019 | Cardonha et al. | |
| 2014/0180480 | A1 * | 6/2014 | Lee | F24F 11/62 700/275 |
| 2016/0242680 | A1 * | 8/2016 | Arif | A61B 5/746 |
| 2019/0196577 | A1 * | 6/2019 | Sronipah | A47C 31/126 |
| 2020/0338983 | A1 * | 10/2020 | Alalao | B60K 35/00 |

OTHER PUBLICATIONS

"Sirajum, Ripudaman, Craig, Juncheng, Jonathan, Chales, Christopher, Anthony, and Mario, Real-Time Fine Grained Occupancy Estimation using Depth Sensors on ARM Embedded Platforms, 2017, IEEE, 295-306" (Year: 2017).*

(Continued)

*Primary Examiner* — Nelson J Nieves
*Assistant Examiner* — Meraj A Shaikh
(74) *Attorney, Agent, or Firm* — Brooks Kushman P.C.

(57) ABSTRACT

Occupant thermal comfort may be inferred and improved using body shape information. Height, weight, and shoulder circumference of an occupant of a room may be obtained using a depth sensor. A model may be utilized that is trained on a dataset including information reflecting of occupant comfort within the room versus temperature, the model receiving, as inputs, the height, the weight, and the shoulder circumference of the occupant and environmental information and outputting a comfort class. A temperature set-point for is identified which the room occupant is identified by the model as having the comfort class being indicative of user comfort. Heating, ventilation, and air conditioning (HVAC) controls are adjusted for the room to the identified temperature set-point.

20 Claims, 11 Drawing Sheets

(56) References Cited

OTHER PUBLICATIONS

Chang et al., Battle for the Thermostat: Gender and the Effect of Temperature on Cognitive Performance, PLoS One 14(5): e0215966, May 22, 2019.
Fisk, How IEQ Affects Health, Productivity, American Society of Heating, Refrigerating and Air-Conditioning Engineers, Inc. (ASHRAE) Journal 44, May 2002.
Cui et al., Influence of Indoor Air Temperature on Human Thermal Cornrort, Motivation and Performance, Building and Environment 68, 2013.
Frontczak et al., Literature Survey on How Different Factors Influence Human Comfort in Indoor Environments, Building and Environment, vol. 46, Issue 4, pp. 922-937, Apr. 2011.
Khalil et al., SonicDoor: Scaling Person Identification with Ultrasonic Sensors by Novel Modeling of Shape, Behavior and Walking Patterns, BuildSys '17, Nov. 2017, Delft, The Netherlands.
Munir et al., Real-Time Fine Grained Occupancy Estimation Using Depth Sensors on ARM Embedded Platforms, 2017 Institute of Electrical and Electronics Engineers (IEEE) Real-Time and Embedded Technology and Applications Symposium (RTAS).
Gagge et al., An Effective Temperature Scale Based on a Simple Model of Human Physiological Regulatory Response, ASHRAE Transactions, vol. 77, Part I, 1971.
De Dear et al., Developing an Adaptive Model of Thermal Comfort and Preference, ASHRAE Transactions 1998, vol. 104, Part 1.
Barrios, et al., The Comfstat—Automatically Sensing Thermal Comfort for Smart Thermostats, 2017 IEE International Conference on Pervasive Computing and Communications (PerCom).
Kim et al., Personal Comfort Models—A New Paradigm in Thermal Comfort for Occupant-Centric Environmental Control, Building and Environment, vol. 132, No. 15, Mar. 2018.
Enescu, A Review of Thermal Comfort Models and Indicators for Indoor Environments, Renewable and Sustainable Energy Reviews 79, Supplement C (2017) 1353-1379.
Klein et al., Coordinating Occupant Behavior for Building Energy and Comfort Management Using Multi-Agent Systems, Automation in Construction, vol. 22, pp. 525-536, 2012.
Putta et al., A Distributed Approach to Efficient Model Predictive Control of Building HVAC Systems, International High Performance Buildings Conference, Paper 83, 2012.
Mansourifard et al., Online Learning for Personalized Room-Level Thermal Control: A Multi-Armed Bandit Framework, Proceedings of the 5th Association for Computing Machinery (ACM) Workshop on Embedded Systems for Energy-Efficient Buildings, Nov. 14, 2013.
Zhang et al., Strategy-Proof Thermal Comfort Voting in Buildings, BuildSys 2014, Proceedings of 1st Association for Computing Machinery (ACM) Conference on Embedded Systems for Energy-Efficient Buildings, Nov. 5-6, 2014.
Gao et al., SPOT: A Smart Personalized Office Thermal Control System, e-Energy 2013, Proceedings of the 4th International Conference on Future Energy Systems, May 2013.
Gao et al., Optimal Personal Comfort Management Using SPOT+, BuildSys 2013, Proceedings of the 5th Association for Computing Machinery (ACM) Workshop on Embedded Systems for Energy-Efficient Buildings, Nov. 2013.
Babakus et al., Adapting the SERVQUAL Scale to Hospital Services: An Empirical Investigation, Health Services Research, vol. 26, No. 6, Feb. 1992.
Sachdev et al., Relative Importance of Service Quality Dimensions: A Multisectoral Study, Journal of Services Research, vol. 4, No. 1, Apr.-Sep. 2004.
Lloyd, Least Squares Quantization in PCM, Institute of Electrical and Electronics Engineers (IEEE) Transactions on Information Theory, vol. 28, No. 2, Mar. 1982.
Kalogirou, Applications of Artificial Neural-Networks for Energy Systems, Applied Energy, vol. 67, Issues 1-2, Sep. 2000.
Kim et al., Personal Comfort Models: Predicting Individuals' Thermal Preference Using Occupant Heating and Cooling Behavior and Machine Learning, Building and Environment, vol. 129, No. 1, Feb. 2018.
Kingma, Adam: A Method for Stochastic Optimization, International Conference on Learning Representations (ICLR), 2015.
Ghahramani et al., An Online Learning Approach for Quantifying Personalized Thermal Comfort Via Adaptive Stochastic Modeling, Building and Environment, vol. 92, Oct. 2015.
Mithun et al., ODDS: Real-Time Object Detection Using Depth Sensors on Embedded GPUs, in Proceedings of IPSN '18 (International Conference on Information Processing in Sensor Networks), Apr. 2018.
Jiang et al., Data-Driven Thermal Model Inference with ARMAX, in Smart Environments, Based on Normalized Mutual Information, 2018 Annual American Control Conference (ACC).
Szokolay, Introduction to Architectural Science: The Basis of Sustainable Design, Taylor & Francis, 2008.
Rabbani et al., The Spot* Personal Thermal Comfort System, BuildSys '16, in Proceedings of the 3rd ACM International Conference on Systems for Energy-Efficient Built Environments, Nov. 2016.
Standard 55 User's Manual based on ANSI/ASHRAE (American Society of Heating Refrigerating and Air-Conditioning Engineers) Standard 55-2013 Thermal Environmental Conditions for Human Occupancy.
Francis et al., Poster Abstract: Context Intelligence in Pervasive Environments, IoTDI '17, IEEE/ACM 2nd International Conference on Internet-of-Things Design and Implementation (IoTDI), Apr. 2017.
Jazizadeh et al., Short Paper: Can Computer Visually Quantify Human Thermal Comfort?, ACM BuildSys '16, in Proceedings of 3rd ACM International Conference on Systems for Energy-Efficient Built Environments, Nov. 2016.

* cited by examiner

500

OCCUPANT THERMAL COMFORT INFERENCE USING BODY SHAPE INFORMATION

STATEMENT REGARDING FEDERALLY SPONSORED RESEARCH OR DEVELOPMENT

The invention was made with government support under Grant No. DE-EE0007682 awarded by the United States Department of Energy. The government has certain rights to the invention.

TECHNICAL FIELD

The present disclosure relates to aspects of using body shape information alone or in combination with other information to infer and improve occupant thermal comfort.

BACKGROUND

Thermal comfort is an important factor in building control. It drives the operation of heating, ventilation, and air conditioning (HVAC) systems, which are estimated to account for 50% of the total energy use in the built environment. Moreover, thermal comfort has a significant effect on the physiological and psychological wellbeing of an individual and affects occupants' health, satisfaction, and performance (Tom Y. Chang and Agne Kajackaite. 2019. Battle for the thermostat: Gender and the effect of temperature on cognitive performance. *Plos One* 14, 5 (2019); and William J Fisk. 2002. How IEQ affects health, productivity. *ASHRAE journal* 44 (2002)). Studies have shown that it can lead to either an increase in concentration and productivity in optimal comfort conditions or to lethargy and distraction in poor comfort conditions (Weilin Cui, Guoguang Cao, Jung Ho Park, Qin Ouyang, and Yingxin Zhu. 2013. Influence of indoor air temperature on human thermal comfort, motivation and performance. *Building and Environment* 68 (2013), 114-122; and Monika Frontczak and Pawel Wargocki. 2011. Literature survey on how different factors influence human comfort in indoor environments. *Building and Environment* 46, 4 (2011), 922-937).

Many commercial building control systems in use are based on models that regulate thermal conditions, often by means of pre-defined rules with pre-defined set-points, i.e., the goal temperature in an indoor environment. Temperature set-points are either derived from well-established standards, such as ASHRAE 55 (American Society of Heating Refrigerating and Air-Conditioning Engineers. Standards Committee. 2013. Thermal environmental conditions for human occupancy. *ASHRAE standard;* 55-2013 2013, STANDARD 55 (2013), 1-44), or require continuous feedback from occupants by means of surveys or wearables. Few building control systems prioritize the occupants' inherent physical characteristics, e.g., body shape information (height, weight, shoulder circumference), when making these thermal comfort estimates.

The sophistication of non-invasive sensing and privacy preserving occupancy-tracking systems has improved greatly in the last decade, making occupant tracking and occupant parameter estimation more ubiquitous (Nacer Khalil, Driss Benhaddou, Omprakash Gnawali, and Jaspal Subhlok. 2017. Sonicdoor: scaling person identification with ultrasonic sensors by novel modeling of shape, behavior and walking patterns. (2017), 3; and S. Munir, R. S. Arora, C. Hesling, J. Li, J. Francis, C. Shelton, C. Martin, A. Rowe, and M. Berges. 2017. Real-Time Fine Grained Occupancy Estimation Using Depth Sensors on ARM Embedded Platforms. In 2017 *IEEE Real-Time and Embedded Technology and Applications Symposium* (*RTAS*). 295-306). Thermal comfort prediction, on the other hand, remains a fundamental challenge in this domain, due to the stochasticity of the environment, the non-stationarity of human thermal comfort preferences, and the prohibitive cost of performing large-scale thermal comfort data-collection.

Thermal comfort has a considerable influence on the overall satisfaction in indoor environments (Weilin Cui, Guoguang Cao, Jung Ho Park, Qin Ouyang, and Yingxin Zhu. 2013. Influence of indoor air temperature on human thermal comfort, motivation and performance. *Building and Environment* 68 (2013), 114-122; and Monika Frontczak and Pawel Wargocki. 2011. Literature survey on how different factors influence human comfort in indoor environments. *Building and Environment* 46, 4 (2011), 922-937). Many building control systems rely on generic thermal comfort models for temperature regulation that average the air temperature to achieve thermal comfort among building occupants. The most widely used models are the Predicted Mean Vote model (PMV) (Poul O. Fanger. 1967. Calculation of thermal comfort, Introduction of a basic comfort equation. *ASHRAE transactions* 73, 2 (1967), 111-4), the Pierce Two-Node Model (PTNM) (Adolf P. Gagge. 1971. An effective temperature scale based on a simple model of human physiological regulatory response. *Ashrae Trans.* 77 (1971), 247-262), and the RP-884 model (Richard J. de Dear, Gail Schiller Brager, James Reardon, Fergus Nicol, et al. 1998. Developing an adaptive model of thermal comfort and preference/discussion. *ASHRAE transactions* 104 (1998), 145). The PMV and the PTNM models were introduced in the 1970s; the basis of both models are laboratory studies that take physiological parameters as well as environmental data into account (Poul O. Fanger. 1967. Calculation of thermal comfort, Introduction of a basic comfort equation. *ASHRAE transactions* 73, 2 (1967), 111-4; Adolf P. Gagge. 1971. An effective temperature scale based on a simple model of human physiological regulatory response. *Ashrae Trans.* 77 (1971), 247-262). This data includes air temperature, mean radiant temperature, relative humidity, and air velocity, and, as for human factors, clothing insulation and metabolic rate. All three mentioned models consider human factors, rather than using specific set-points, but they average the individual occupants' responses.

Recent literature employs machine learning in order to contextualize environmental data by means of supervised comfort modeling (L. Barrios and W. Kleiminger. 2017. The Comfstat—automatically sensing thermal comfort for smart thermostats. In 2017 *IEEE International Conference on Pervasive Computing and Communications* (*PerCom*). 257-266; Weilin Cui, Guoguang Cao, Jung Ho Park, Qin Ouyang, and Yingxin Zhu. 2013. Influence of indoor air temperature on human thermal comfort, motivation and performance. *Building and Environment* 68 (2013), 114-122). In a study with 38 participants, Kim et al. (Joyce Kim, Stefano Schiavon, and Gail Brager. 2018. Personal comfort models—A new paradigm in thermal comfort for occupant-centric environmental control. *Building and Environment* 132 (2018), 114-124) show that personalized thermal comfort models perform better than conventional models, such as the PMV, due to the increased model representational capacity. The evaluation in (L. Barrios and W. Kleiminger. 2017. The Comfstat—automatically sensing thermal comfort for smart thermostats. In 2017 *IEEE International Conference on Pervasive Computing and Communications* (*PerCom*). 257-266) assesses whether or not thermal comfort can be determined by sensor data and environmental variables, and the authors show promising results in personalized models, with an average of 83% across their 7 participants. Their results are compared against an always-comfortable model as well as a linear regression model that only uses temperature as input. However, generalizability is hard to conclude given these cohort sizes, whose data may not capture the non-stationary properties of human comfort preference as well as ambient environmental phenomena (Diana Enescu. 2017. A review of thermal comfort models and indicators for indoor environments. *Renewable and Sustainable Energy Reviews* 79, Supplement C (2017), 1353-1379; Laura Klein, Jun Young Kwak, Geoffrey Kavulya, Farrokh Jazizadeh, Burcin Becerik-Gerber, Pradeep Varakantham, and Milind Tambe. 2012. Coordinating occupant behavior for building energy and comfort management using multiagent systems. *Automation in Construction* 22 (2012), 525-536; V. Putta, G. Zhu, D. Kim, J. Hu, and J. Braun. 2012. A Distributed Approach to Efficient Model Predictive Control of Building HVAC Systems. *International High Performance Buildings Conference* (2012)). Moreover, these approaches do not address the role of body shape information (e.g., height, weight, and shoulder circumference) in the thermal comfort predictions.

Similar attempts that promote personalized comfort models also include occupant feedback, human factors, and bio-signal data (e.g., heart rate, skin temperature, and galvanic skin response) (Parisa Mansourifard, Farrokh Jazizadeh, Bhaskar Krishnamachari, and Burcin Becerik-Gerber. 2013. Online learning for personalized room-level thermal control: A multi-armed bandit framework. In *Proceedings of the 5th ACM Workshop on Embedded Systems For Energy-Efficient Buildings*. ACM, 1-8; Liang Zhang, Abraham Hang-yat Lam, and Dan Wang. 2014. Strategy-proof thermal comfort voting in buildings. In *Proceedings of the 1st ACM Conference on Embedded Systems for Energy-Efficient Buildings*. ACM, 160-163). Another approach proposes to use body features that are identified through video and shows that the human thermoregulation state can be inferred from the human skin (Farrokh Jazizadeh and S Pradeep. 2016. Can computers visually quantify human thermal comfort?: Short paper. In *Proceedings of the 3rd ACM International Conference on Systems for Energy-Efficient Built Environments*. ACM, 95-98). On a similar basis, the FORK system uses a depth sensor to detect, track, and estimate occupancy in buildings (S. Munir, R. S. Arora, C. Hesling, J. Li, J. Francis, C. Shelton, C. Martin, A. Rowe, and M. Berges. 2017. Real-Time Fine Grained Occupancy Estimation Using Depth Sensors on ARM Embedded Platforms. In 2017 *IEEE Real-Time and Embedded Technology and Applications Symposium* (*RTAS*). 295-306).

Other approaches, such as SPOT (Peter Xiang Gao and Srinivasan Keshav. 2013. SPOT: a smart personalized office thermal control system. In *Proceedings of the fourth international conference on Future energy systems*. ACM, 237-246) and SPOT+(Peter Xiang Gao and Srinivasan Keshav. 2013. Optimal personal comfort management using SPOT+. In *Proceedings of the 5th ACM Workshop on Embedded Systems For Energy-Efficient Buildings*. ACM, 1-8), describe occupancy sensing systems for thermal control; as a result, the goal of these works is to generate a zone temperature set-point, as opposed to comfort predictions. SPOT uses the Predicted Personal Vote (PPV) model, which takes Fanger's PMV (Poul O. Fanger. 1967. Calculation of thermal comfort, Introduction of a basic comfort equation. *ASHRAE transactions* 73, 2 (1967), III-4) and adds a linear function to include the individual's sensitivity to the variables used by the PMV. Gao and Keshav (Peter Xiang Gao and Srinivasan Keshav. 2013. Optimal personal comfort management using SPOT+. In *Proceedings of the 5th ACM Workshop on Embedded Systems For Energy-Efficient Buildings*. ACM, 1-8) show reductions in user discomfort, from 0.36 to 0.02, as compared to baselines.

SUMMARY

According to one or more illustrative examples, a method for inferring and improving occupant thermal comfort accounting for body shape information includes obtaining height, weight, and shoulder circumference of an occupant of a room using a depth sensor; utilizing a model trained on a dataset including information reflecting of occupant comfort within the room versus temperature, the model receiving, as inputs, the height, the weight, and the shoulder circumference of the occupant and environmental information and outputting a comfort class; identifying a temperature set-point for which the room occupant is identified by the model as having the comfort class being indicative of user comfort; and adjusting HVAC controls for the room to the identified temperature set-point.

According to one or more illustrative examples, a system for inferring and improving occupant thermal comfort accounting for body shape information includes a memory storing instructions; and a processor. The processor is programmed to execute the instructions to perform operations including to, responsive to detecting an occupant entering a room, obtain height, weight, and shoulder circumference of the occupant of the room using a depth sensor mounted to a ceiling of the room; utilize a model trained on a dataset including information reflecting of occupant comfort within the room versus temperature, the model receiving, as inputs, the height, the weight, and the shoulder circumference of the occupant and environmental information and outputting a comfort class; identify a temperature set-point for which the room occupant is identified by the model as having the comfort class being indicative of user comfort; and adjust HVAC controls for the room to the identified temperature set-point.

According to one or more illustrative examples, a non-transitory computer-readable medium includes instructions for inferring and improving occupant thermal comfort accounting for body shape information that, when executed by a processor, cause the processor to, responsive to detecting an occupant entering a room, obtain height, weight, and shoulder circumference of the occupant of the room using a depth sensor mounted to a ceiling of the room; utilize a model trained on a dataset including information reflecting of occupant comfort within the room versus temperature, the model receiving, as inputs, the height, the weight, and the shoulder circumference of the occupant and environmental information and outputting a comfort class; identify a temperature set-point for which the room occupant is identified by the model as having the comfort class being indicative of user comfort; and adjust HVAC controls for the room to the identified temperature set-point.

DETAILED DESCRIPTION

Figure 1:
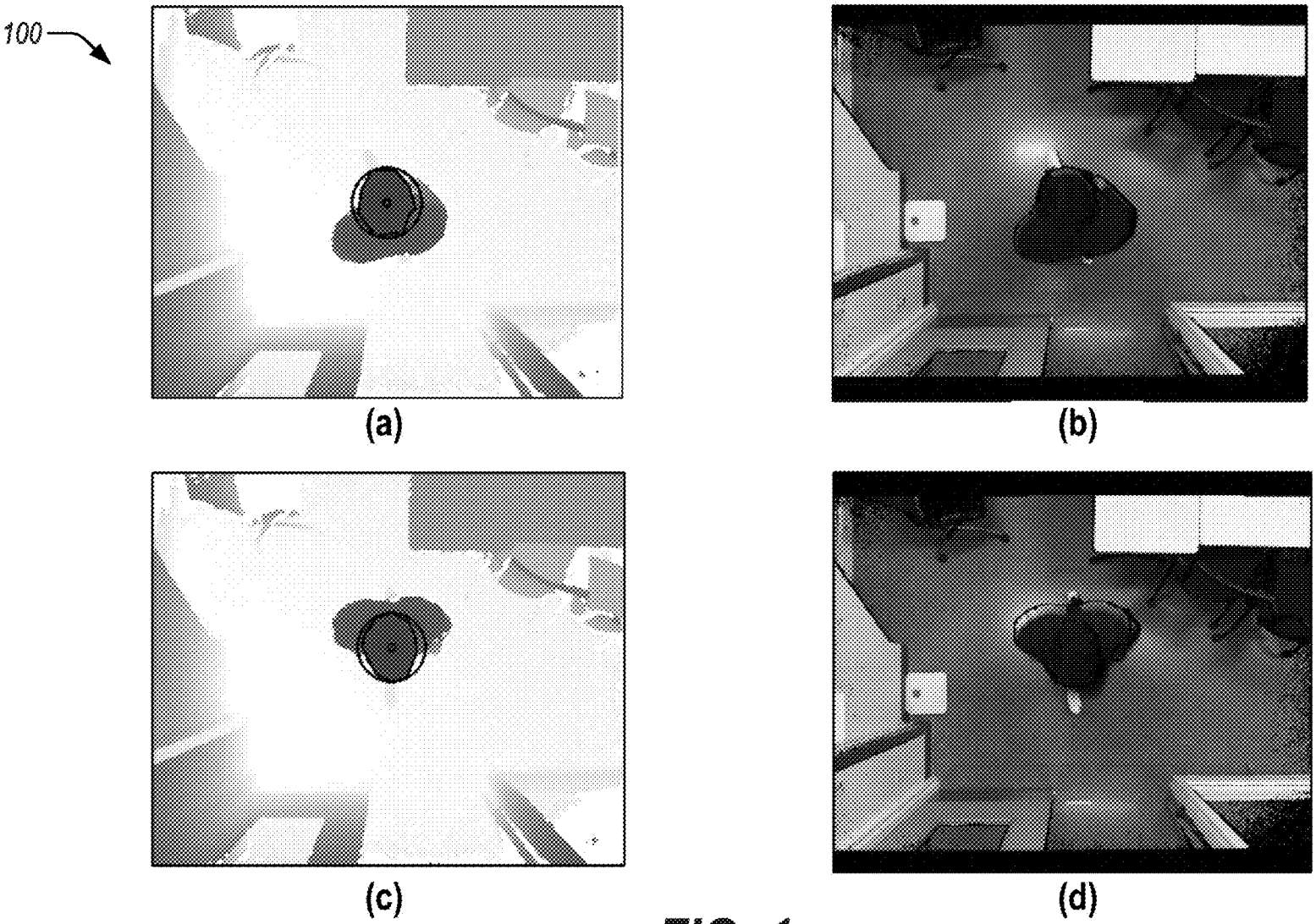
FIG. 1 illustrates an example set of depth frames and corresponding red green blue (RGB) images.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Thermal comfort is a decisive factor for the well-being, productivity, and overall satisfaction of commercial building occupants. Many commercial building automation systems either use a fixed zone-wide temperature set-point for all occupants or they rely on extensive sensor deployments with frequent online interaction with occupants. This results in inadequate comfort levels or significant training effort from users, respectively. However, the increasing ubiquity of cheap, depth-based occupancy tracking systems has enabled an improvement in inferential capabilities.

Human physiology implies that body shape does play an important part in thermal comfort. An individual with a larger body surface offers a larger area for sensing the temperature outside the body. Additionally, adipose tissue has the effect of trapping heat, meaning that the human core stays warm while the body surface, i.e., the skin, cools down This disclosure describes an improved system that may be used for predicting thermal comfort preferences of occupants by leveraging their body shape information. The disclosed approach improves the accuracy of thermal comfort predictions, alleviates the need for frequent occupant comfort feedback during system deployment, and leverages data from existing commercial building sensing infrastructures. Based on a human study experiment where data was collected from human participants, a model was developed to infer thermal comfort of individuals using body shape information. This is a novel and nonobvious approach to infer thermal comfort of individuals. Moreover, in order to emphasize the increased inferential power that body shape information offers to comfort modeling, the model may be compared with other instances of the same hyperparameter configuration that are trained only on an ablated set of feature inputs. Based on the comparison with model baselines and ablations, the described approach infers thermal comfort of individuals with greater accuracy when body shape information is taken into account. The model may also be configured for temperature set-point prediction, showing that the described strategy performs proximally to state-of-the-art techniques.

In this disclosure, the FORK system is extended to include physiological body shape information in order to infer the individual's thermal comfort preferences. When an occupant enters a room, their height, weight, and shoulder circumference are obtained using a depth-based occupancy tracking assembly, based on FORK (S. Munir, R. S. Arora, C. Hesling, J. Li, J. Francis, C. Shelton, C. Martin, A. Rowe, and M. Berges. 2017. Real-Time Fine Grained Occupancy Estimation Using Depth Sensors on ARM Embedded Platforms. In 2017 *IEEE Real-Time and Embedded Technology and Applications Symposium* (*RTAS*). 295-306). This body shape information may be combined with environmental sensor data from the commercial Building Automation and Control Network (BACNet) infrastructure on our campus. The occupant's thermal comfort preference may be classified, conditioned on the body shape information and the environmental factors. Using the set of comfort predictions, an optimal zone temperature set-point range may be inferred.

Regarding performing body shape inference, the Fine-grained Occupancy estimatoR using Kinect (FORK) system (S. Munir, R. S. Arora, C. Hesling, J. Li, J. Francis, C. Shelton, C. Martin, A. Rowe, and M. Berges. 2017. Real-Time Fine Grained Occupancy Estimation Using Depth Sensors on ARM Embedded Platforms. In 2017 *IEEE Real-Time and Embedded Technology and Applications Symposium* (*RTAS*). 295-306) uses a ceiling-mounted depth sensor to estimate the number of occupants in a room. To identify and track humans in the sensor's field-of-view, FORK uses a model-based approach which relies on the anthropometric properties of human heads and shoulders. The human detection algorithm of FORK may be used to determine body shape information in the disclosed approach. One reason to utilize a depth sensor for estimating body shape (as opposed to an RGB camera, for example) is that the depth sensor is considerably less privacy-invasive: a depth sensor cannot sense skin color, hair, cloth, and—since it is mounted overhead—it cannot see facial features. Hence, it is difficult to identify individuals using depth frames, even if the sensor is compromised. The disclosed approach may perform the computation at the edge and accordingly may operate without the upload of image data to a remote server. In one example, the disclosed approaches uses the Microsoft Kinect V2, which provides depth frames at a 512×424 resolution.

FIG. 1 illustrates an example 100 set of depth frames and corresponding RGB images. As shown, the example 100 includes a sample depth frame (a) and corresponding RGB image (b) of someone entering a room, and a sample depth frame (c) and corresponding RGB image (d) of the person exiting the room. The disclosed approach uses such depth frames to estimate height and shoulder circumference of occupants.

With respect to determining height, responsive to FORK detecting a human head, it fits a contour and a minimum enclosing circle around the head, as shown in the sample depth frame (a). Among all the pixels within the circle, the system locates a pixel $P_{min}$=(px, py) that has the minimum depth value $D_{min}$. Note that, since a depth sensor provides distance to its nearest object in millimeters, $P_{min}$ is the pixel representing the highest point on the head of the person. In order to estimate the participant's height, the system estimates floor height $F_{max}$ by building a histogram of number of depth pixels at different distances from the sensor, as in FORK. The bin with the highest number of pixels is considered the floor. The height of the person is then computed as $F_{max}-D_{min}$. Since a person is captured in multiple frames while he or she enters and exits, the height may be estimated when the person is directly underneath the sensor, such that height estimations at the edges of the frame may be ignored.

Figure 3:
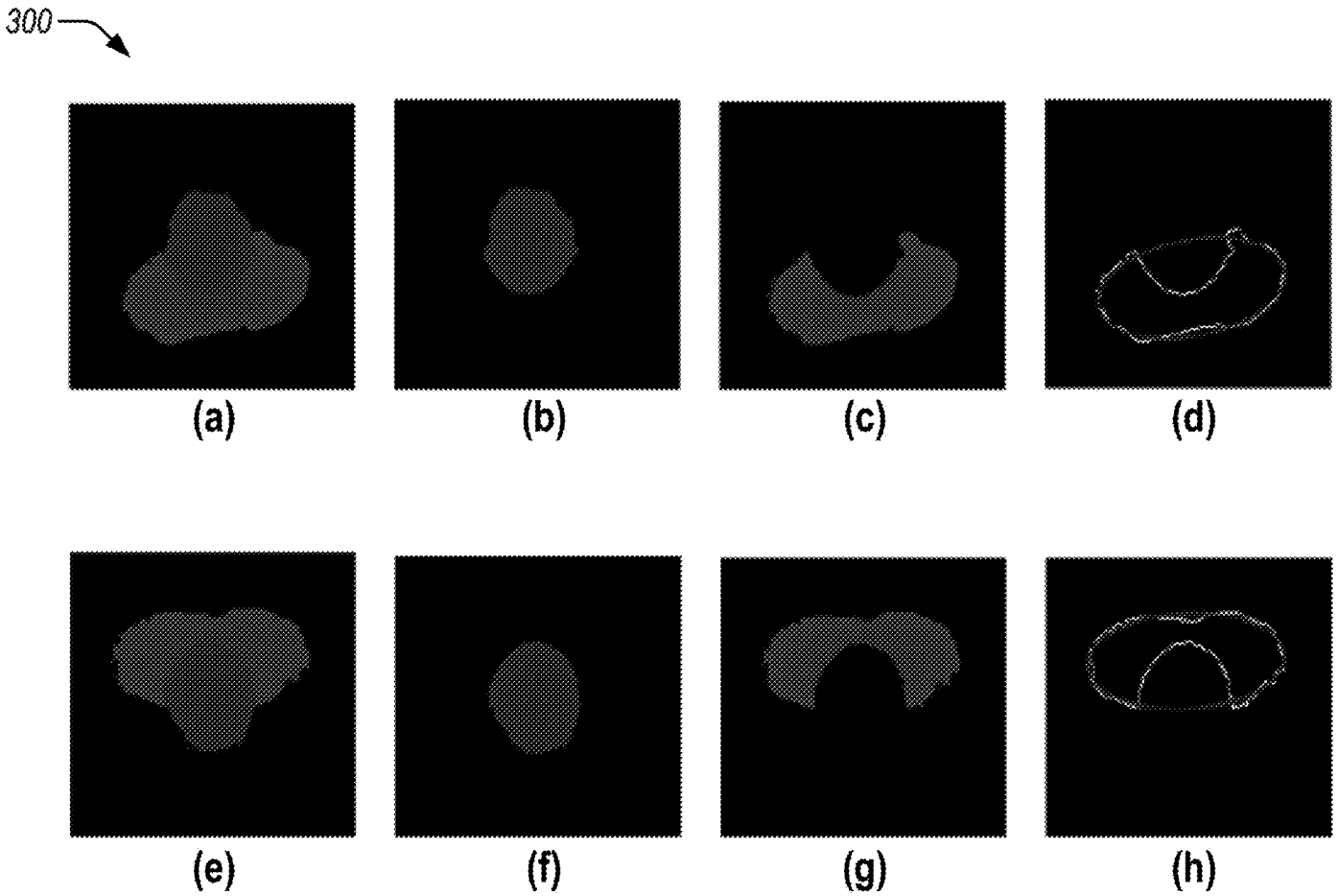
FIG. 3 illustrates an example of a shoulder circumference estimation.

FIG. 3 illustrates an example 300 of a shoulder circumference estimation. As shown, images (a)-(d) indicate aspects of shoulder circumference estimation for a user entering a room, while images (e)-(h) indicate aspects of shoulder circumference estimation for a user exiting the room. With respect to determining shoulder circumference, the system determines shoulder circumference using anthropometric properties of human bodies. FORK itself does not estimate shoulder circumference, it merely detects the presence of a shoulder. To estimate shoulder circumference, the system may use an approach including obtaining a center of the head, e.g., using FORK.

Given that the end-to-end distance between two shoulders of a person is approximately three times the diameter of head, the system fits a region-of-interest (ROI) that includes the head and shoulder and discards all pixels below a threshold $D_{min}$+H+S, in order to discard depth values below the shoulder level. An example is shown in FIG. 3(*a*). The system further captures the head by discarding all the depth pixels below a threshold H, which is a bit less than the length of an average human head. An example is shown in FIG. 3(*b*). The thresholds H, S may be set to 150 and 300 millimeters, respectively. The system then subtracts the second image from the first image to capture the shoulder. An example is shown in FIG. 3(*c*). Using the result, the system detects contours using the third image and fits an ellipse to determine the circumference of the shoulder. An example is shown in FIG. 3(*d*), in which the fitted ellipse is shown in blue. A similar analysis is shown for images 3(*e*)-(*h*), which show similar steps for a user exiting the room.

The circumference of the ellipse is used to estimate the circumference of the shoulder. Note that the circumference of the ellipse is in the pixel coordinate. In order to map it to real-world shoulder circumference, the system builds a linear-regression model, using elliptical circumference as predictor to fit the training data. However, this approach may suffer when the two shoulders are separated or when one shoulder gets occluded.

Figure 4:
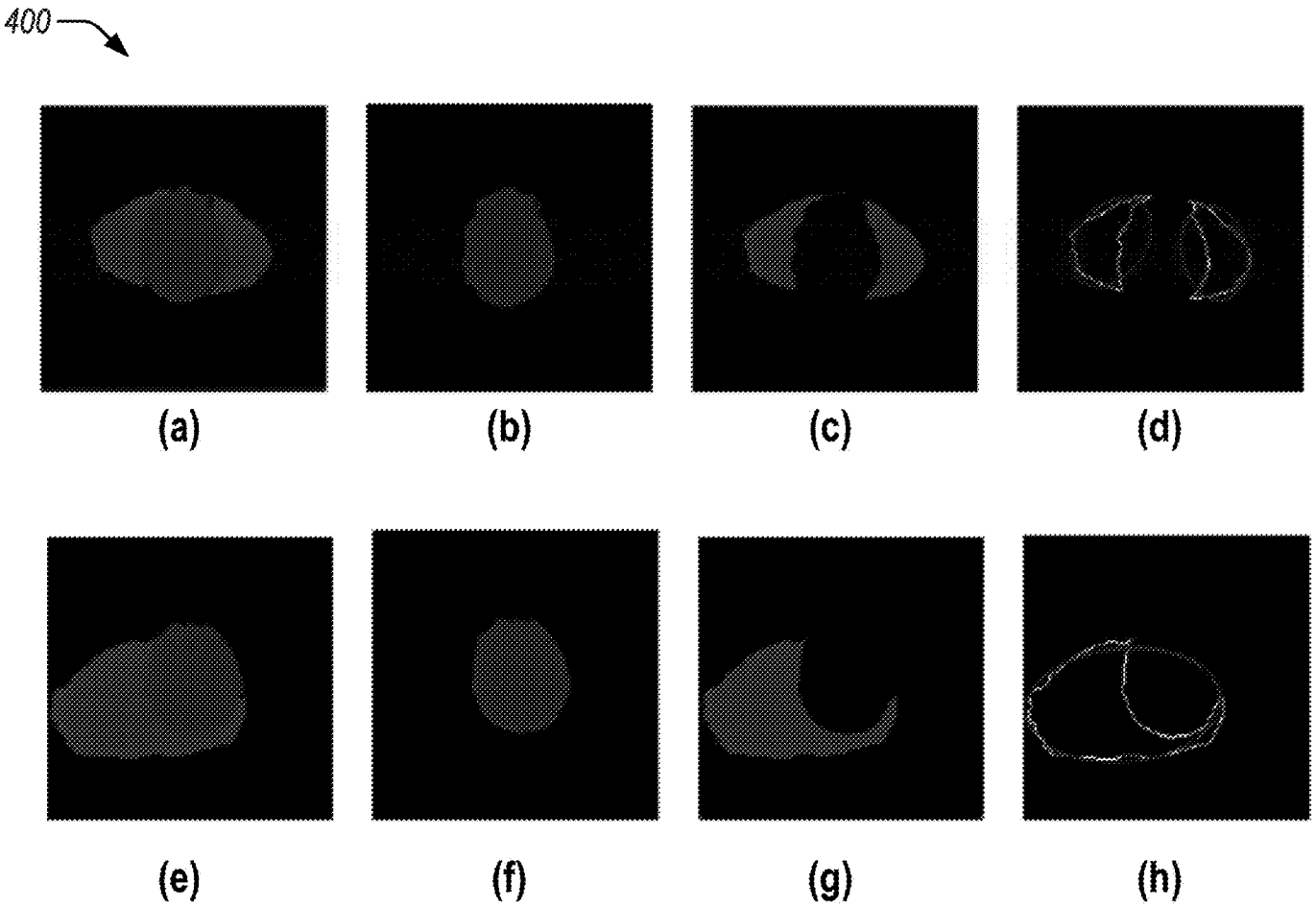
FIG. 4 illustrates an example of a shoulder circumference estimation in an instance with separated shoulders.

FIG. 4 illustrates an example 400 of a shoulder circumference estimation in an instance with separated shoulders. To address situations where the shoulders get separated, the system reports the elliptical circumference as (total sum of circumference of both ellipses)*3/2. When the system selects only one shoulder, the system reports the elliptical circumference as (ellipse circumference)*3/2. The system further uses the linear-regression model, as discussed above, to estimate the real-world shoulder circumference using elliptical circumference as predictor variable.

Figure 5:
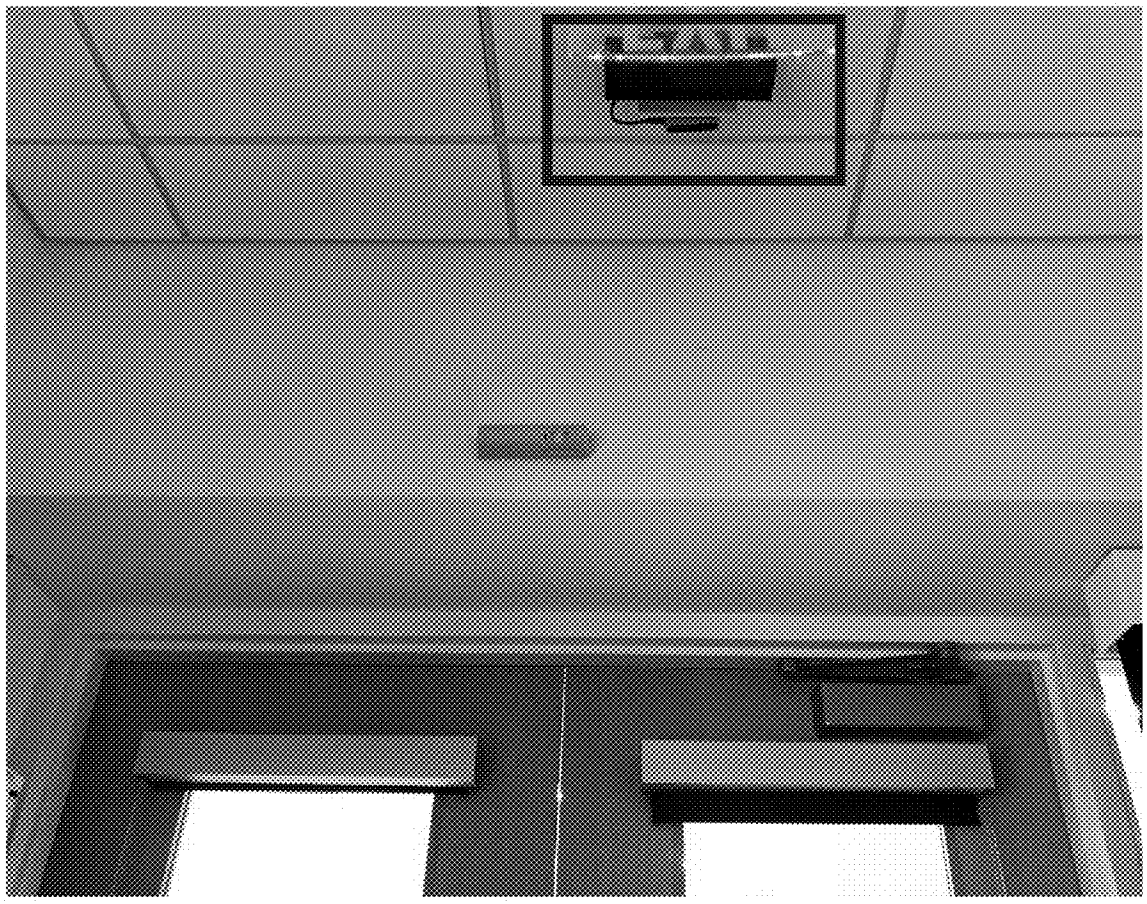
FIG. 5 illustrates an example deployment of a depth sensor installation for the collection of depth data.

FIG. 5 illustrates an example 500 deployment of a depth sensor installation for the collection of depth data. With respect to data collection, the depth sensor may be mounted on or near a ceiling of a room, e.g., above a doorway. An example of the depth sensor may be the Microsoft Kinect V2 depth sensor. As shown in the example, 500, the depth sensor is located behind an exit sign, as highlighted by a rectangle in the example 500. As an additional aspect of data collection, the system may utilize real-time access to the conference room's HVAC actuator state information via BACNet. As yet a further aspect of data collection, a mobile application (not shown, but installed to a smartphone, tablet, or other mobile device in communication with the computing platform) may be used to collect occupant comfort surveys.

In this fully-controlled thermal chamber, individual comfort experiments were performed to generate a dataset than enables comprehensive study of human thermal comfort preferences, in a commercial building environment, across a wide range of indoor environmental conditions. Each comfort experiment lasted for 3.5 hours and began by manually measuring the participant's ground-truth body shape information. In one example, each participant may be asked to pace in and out of the room, beneath the depth camera, to obtain accurate body shape predictions.

Figure 6:
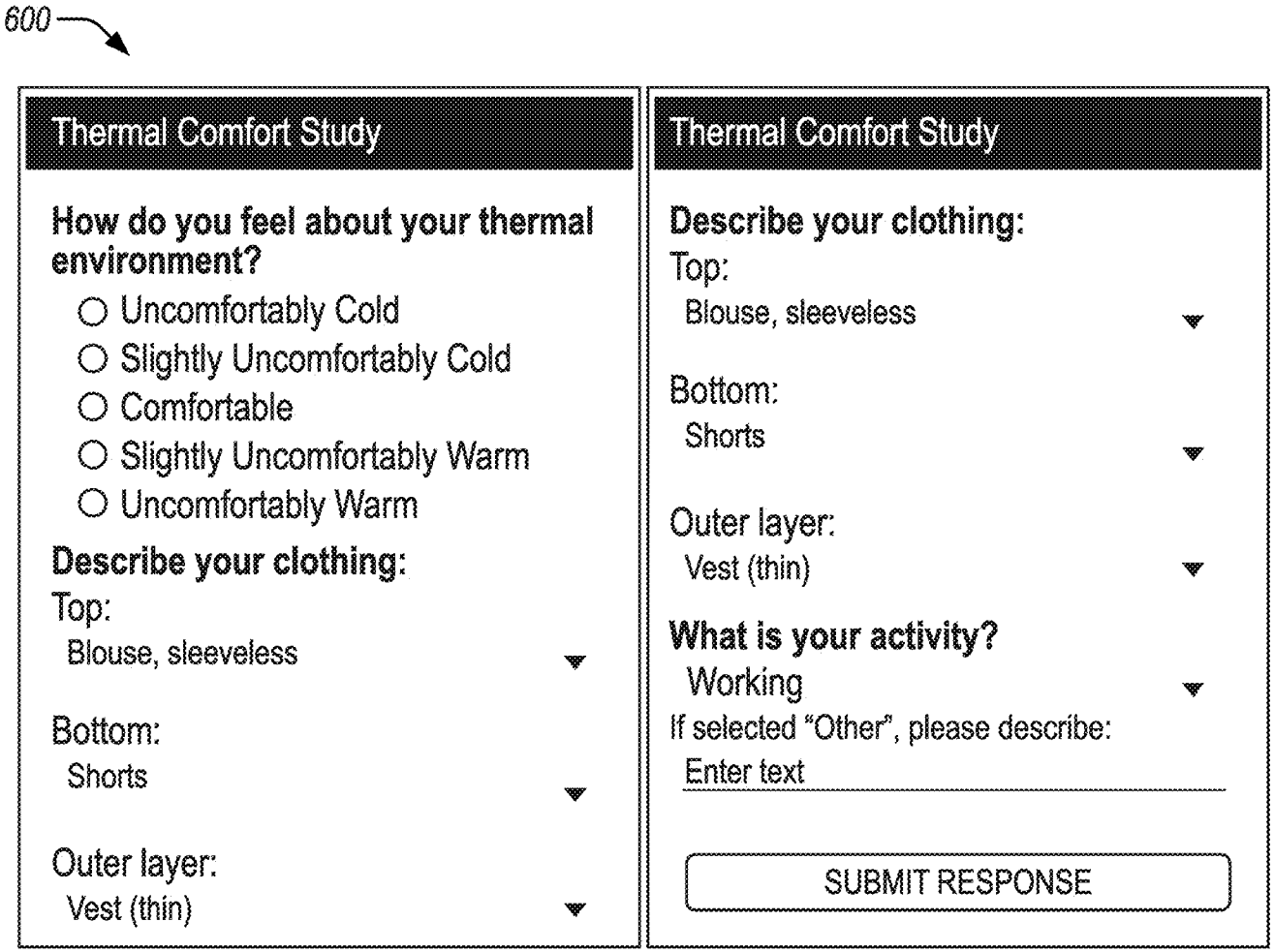
FIG. 6 illustrates an example of a user interface of a mobile application for collecting data from comfort experiment participants.

FIG. 6 illustrates an example 600 of a user interface of a mobile application for collecting data from comfort experiment participants. Each participant may be equipped with a wearable biometrics device and be provided with a smartphone executing a thermal comfort mobile application. An example wearable biometrics device may be the Microsoft Band II wearable device. However, it should be noted that other wearable biometric devices may additionally or alternately be used, such as a wearable fitness tracker that tracks biometrics such as skin temperature, heart rate, and galvanic skin response. Each participant may be instructed to engage in a low-intensity activity of his or her choice (e.g., reading), while completing quick thermal comfort surveys in the mobile application as shown in the example 600. Concurrently, the airflow rate in the room may be fixed, with a variation in the zone temperature via BACNet, between approximately 60° F. to 80° F. (16° C. to 27° C.), according to a cold-hot-cold-hot control schedule.

The participant completed a thermal comfort survey every five minutes or whenever they initiated a change in their clothing level (e.g., adding or removing a sweater) or activity type. Participants provided their comfort votes on the basis of a reduced 5-point ASHRAE 55 scale (American Society of Heating Refrigerating and Air-Conditioning Engineers. Standards Committee. 2013. Thermal environmental conditions for human occupancy. *ASHRAE standard;* 55-2013 2013, STANDARD 55 (2013), 1-44), see Table 1, which is used in order to reduce the complexity of voting.

TABLE 1

Thermal comfort index, discretized thermal comfort label on 5-point scale, the number of responses in the dataset for each tier for the 77 participant subset, and the mapping to the ASHRAE thermal comfort scale.

| Comfort Index | Label | Count | ASHRAE |
|---|---|---|---|
| Uncomfortably Warm | +2 | 48 | Cooler |
| Slightly Uncomfortably Warm | +1 | 198 | |
| Comfortable | 0 | 1152 | No change |

TABLE 1-continued

Thermal comfort index, discretized thermal comfort label on 5-point scale, the number of responses in the dataset for each tier for the 77 participant subset, and the mapping to the ASHRAE thermal comfort scale.

| Comfort Index | Label | Count | ASHRAE |
|---|---|---|---|
| Slightly Uncomfortably Cold | −1 | 452 | Warmer |
| Uncomfortably Cold | −2 | 217 | |

The use of seven-point scales generally improves reliability, however, in a setting where participants are polled in a frequent interval, less steps to perform the task increases the efficacy of the responses (Emin Babakus and W Glynn Mangold. 1992. Adapting the SERVQUAL scale to hospital services: an empirical investigation. *Health services research* 26, 6 (1992); Sheetal B Sachdev and Harsh V Verma. 2004. Relative importance of service quality dimensions: A multisectoral study. *Journal of services research* 4, 1 (2004)). In the instant example study, a main objective was to determine the participant's thermal comfort, which is, according to ASHRAE, mapped to "warmer", "cooler", or "no change". However, it may also be useful to identify whether the participant felt "uncomfortably" or "slightly" warm or cold, as this gives important meta-information for the relevance of a change in temperature for the specific individual. This scale can be mapped to ASHRAE's thermal comfort scale as follows: "slightly uncomfortably cold" and "uncomfortably cold" to "warmer", "comfortable" to "no change", and "slightly uncomfortably warm" and "uncomfortably warm" to "cooler". The ASHRAE's thermal sensation scale is not included here, as it merely indicates the subject's current sensation, but not comfort, which is a more important factor in this case. The thermal comfort index information is summarized in Table 1.

In addition, human subject population statistics are summarized in Table 2. While not shown in the Table 2, self-reported participant Gender was obtained as an additional feature: 34 males and 43 females.

TABLE 2

Participant Population Statistics for the 77 filtered participants in the dataset

| Feature | Min | Max | Mean | Standard Deviation |
|---|---|---|---|---|
| Zone Temperature | 60.1° F. (15.6° C.) | 85.0° F. (29.4° C.) | 71.4° F. (21.9° C.) | 6.22° F. (3.5° C.) |
| Outdoor Temperature | 6.8° F. (−14.0° C.) | 91.4° F. (33.0° C.) | 49.6° F. (9.8° C.) | 20.9° F. (9.8° C.) |
| Skin Temperature | 71.96° F. (22.2° C.) | 95.0° F. (35.0° C.) | 85.1° F. (29.5° C.) | 4.0° F. (2.2° C.) |
| Outdoor Rel. Humidity | 33.5% | 100% | 69.5% | 13.2% |
| Shoulder Circumference | 89.5 cm | 133 cm | 109.3 cm | 10.9 cm |
| Height | 151.0 cm | 191.2 cm | 170.1 | cm |
| Weight | 90 lbs (40.82 kgs) | 236.6 lbs (107.32 kgs) | 153.0 lbs (69.4 kgs) | 30.8 lbs (13.98 kgs) |
| Clothing Insulation (clo) | 0.25 | 1.15 | 0.57 | 0.19 |

Figure 2:
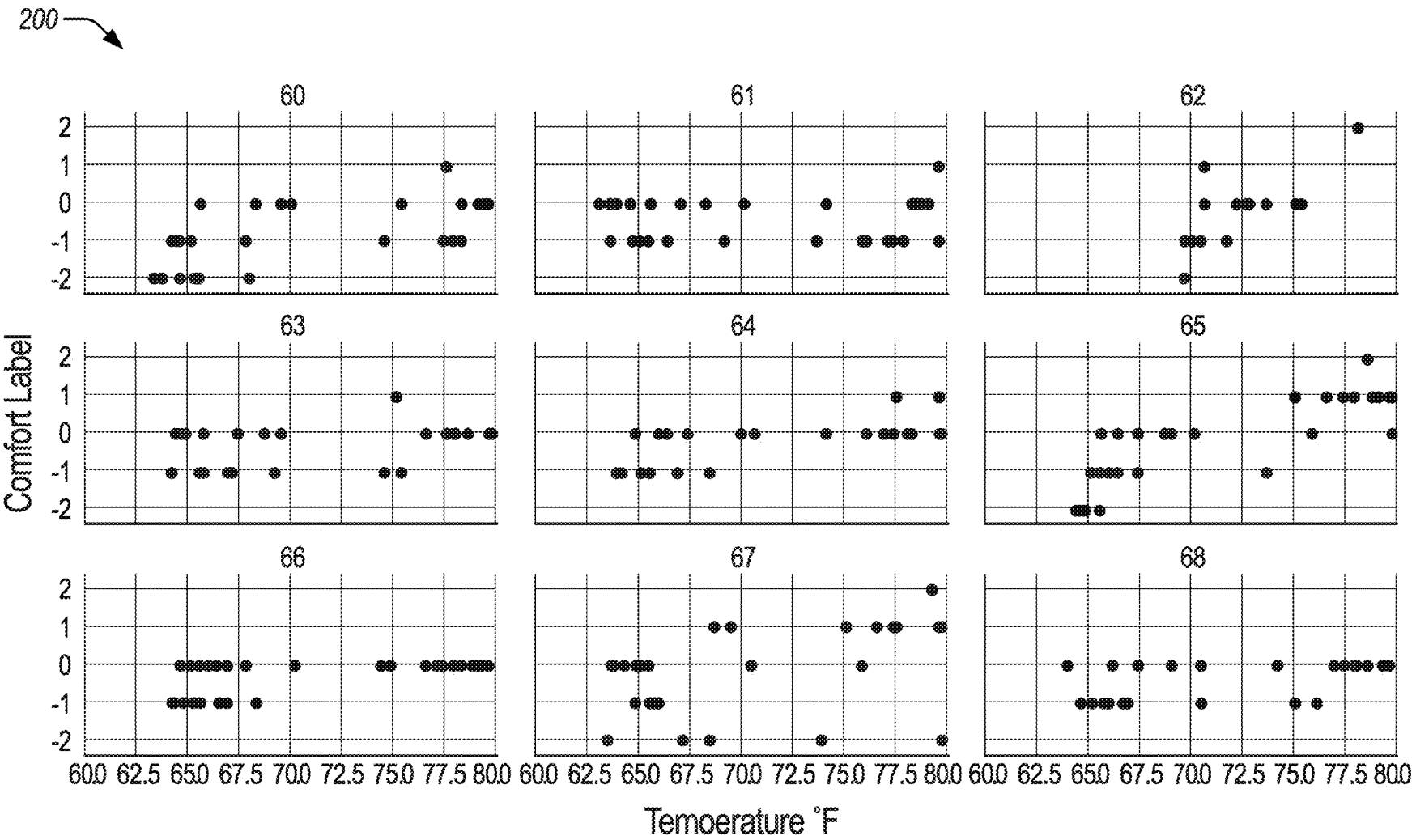
FIG. 2 illustrates an example of plots of participant comfort versus temperature for a subset of thermal comfort human study participants.

FIG. 2 illustrates an example 200 of plots of participant comfort versus temperature for a subset of thermal comfort human study participants. As shown, these sample plots are for nine of the participants, and indicate the comfort labels for each of the participants at various temperatures.

During each experiment, zone air temperature is sampled (e.g., in 30-second intervals), while set point temperature and air flow rate are sampled upon change. Additionally, outside temperature and relative humidity (e.g., with 60-second granularity) are captured from a nearest weather station (in the given example located a quarter mile (half-kilometer) from the experiment location).

Dataset curation may be performed on the collected data. In an example, the collected data may include the following feature groups: biometrics sensor data (band), body shape information (body), subjective comfort data from the mobile device application (survey), environmental sensor data from the HVAC system (HVAC), and outdoor weather station data (weather). The dataset modalities themselves are summarized in Table 3. In Table 3, the samples from band, HVAC, and weather data are aligned to the nearest comfort labels specified by the survey data. The band values may be observed to exhibit little volatility in the space of 1 minute, which for the instant example is the sampling rate of the wearable device and also the maximum temporal difference between survey and band sample timestamps.

Datasets may be generated for evaluation, based on feature subsets of the full data. This may allow for comparison of ablations of the thermal comfort models that are trained with and without, e.g., body shape information, biometrics features, or external weather information. As shown in Table 3, there are five data subsets. Featureset-1 (FS1) includes environmental sensor information, occupant physical characteristics, occupant biometrics, and mobile app survey information. FS2 includes all the feature from FS1, except the body shape information. FS3 includes environmental sensor information and occupant physical characteristics. FS4 includes only environmental sensor information. FS5 includes only zone temperature information.

TABLE 3

Evaluative data subsets

| Collected Features | Lin. Reg. Coeff. x $10^3$ | Feature Sets FS1 | FS2 | FS3 | FS4 | FS5 |
|---|---|---|---|---|---|---|
| Zone Temperature (° F.) | 85.07 | ✓ | ✓ | ✓ | ✓ | ✓ |
| Outdoor Temperature (° F.) | 0.23 | ✓ | ✓ | ✓ | ✓ | X |
| Outdoor Relative Humidity (%) | 1.86 | ✓ | ✓ | ✓ | ✓ | X |
| Shoulder Circumference (cm) | 12.77 | ✓ | X | ✓ | X | X |
| Height (cm) | −0.47 | ✓ | X | ✓ | X | X |
| Weight (lbs) | −2.11 | ✓ | X | ✓ | X | X |
| Skin Temperature (° F.) | −2.84 | ✓ | ✓ | X | X | X |
| Clothing Insulation (clo) | −596 | ✓ | ✓ | X | X | X |
| Gender | −52.59 | ✓ | ✓ | X | X | X |
| Activity | 11.96 | X | X | X | X | X |
| GSR | 0.00 | X | X | X | X | X |

As shown, FS1 includes 9 features. Although other features were collected, such as activity and galvanic skin response (GSR), participants did not report many different classes for the former feature. Many selected 'OTHER' and proceeded to describe their activities in their own words. For the latter, after fitting a linear regression model with all the features, it was identified that GSR contributed the least when compared to the remaining features. Using Featureset-2 (FS2), the effect of omitting body shape characteristics from trained models was examined, through direct comparison with FS1. Featureset-3 (FS3) consisted of a more limited set of features. The inferential value of just these modalities was tested here, since the first two are easily obtained from BACNet and local weather stations, respectively (see Table 3), and the last three are easily regressed or inferred from depth-camera sensor data (S. Munir, R. S. Arora, C. Hesling, J. Li, J. Francis, C. Shelton, C. Martin, A. Rowe, and M. Berges. 2017. Real-Time Fine Grained Occupancy Estimation Using Depth Sensors on ARM Embedded Platforms. In 2017 *IEEE Real-Time and Embedded Technology and Applications Symposium* (*RTAS*). 295-306). Featureset-4 (FS4) tests the inferential value of environmental features alone. Finally, Featureset-5 (FS5) only considers zone temperature and serves as a baseline featureset for which only a room thermostat is needed. Additionally, some participants exhibit missing skin temperature measurements due to faulty connections between the wearable device and the mobile application. To address this, the missing measurements were augmented by implementing the heuristic SkinTemp=RoomTemp+k where k was drawn from a normal distribution with mean and standard deviation calculated, using the heuristic, on the instances where skin temperature was successfully recorded. The previous tables do not consider these new value in their calculations.

Figure 7:
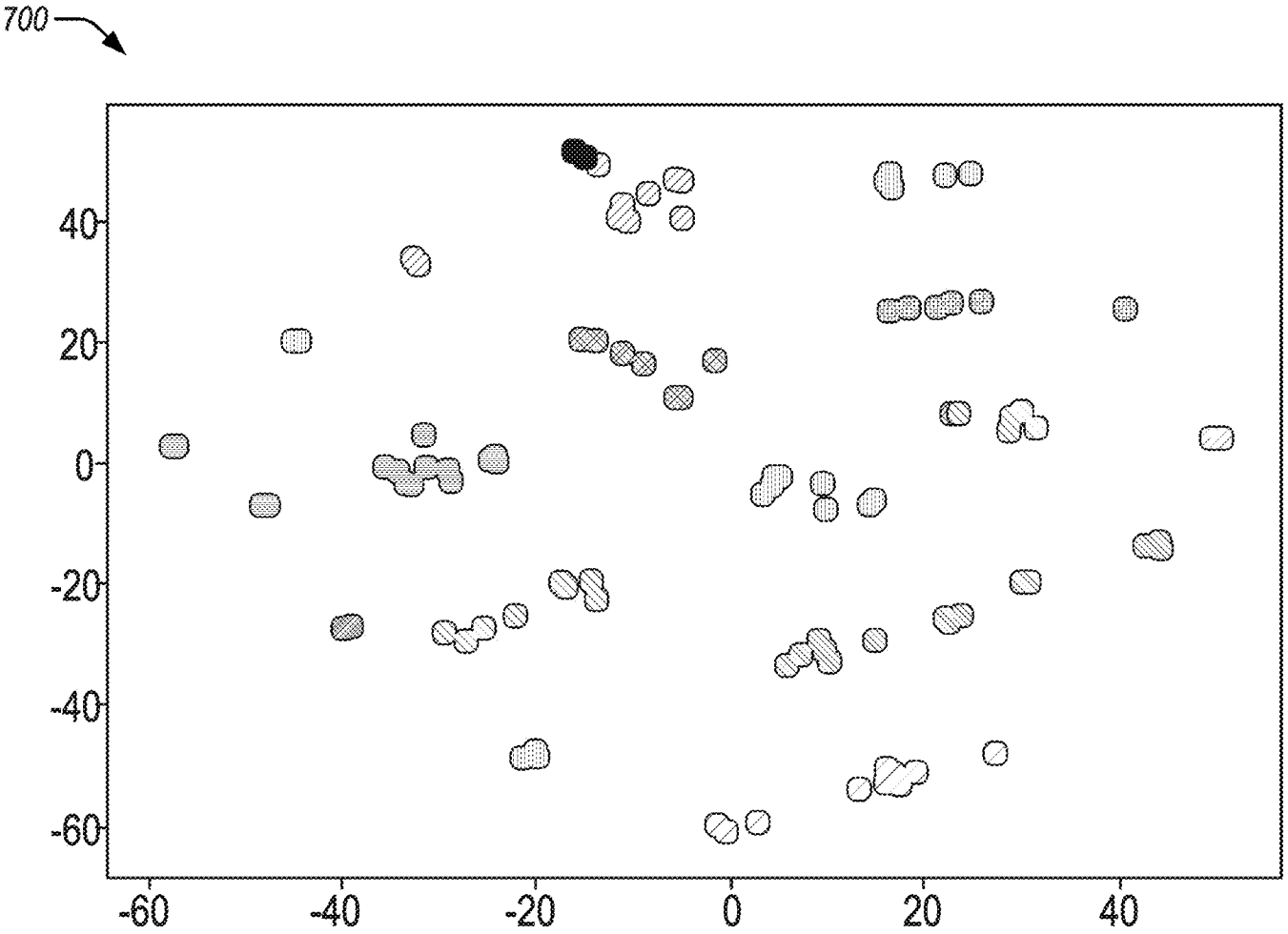
FIG. 7 shows a visualization of clusters in two-dimensional, t-distributed stochastic neighbor embedding space.

FIG. 7 shows a visualization of clusters in two-dimensional, t-distributed stochastic neighbor embedding space (2D t-SNE). It is hypothesized that participants with similar physical characteristics will have similar comfort preferences, as a basis; confounding factors may be satisfied by, e.g., online adaptation or reinforcement of the model, over time (Parisa Mansourifard, Farrokh Jazizadeh, Bhaskar Krishnamachari, and Burcin Becerik-Gerber. 2013. Online Learning for Personalized Room-Level Thermal Control: A Multi-Armed Bandit Framework. In *Proceedings of the 5th ACM Workshop on Embedded Systems For Energy-Efficient Buildings* (*BuildSys* '13). ACM, New York, N.Y., USA, Article 20, 8 pages). K-means (S. Lloyd. 1982. Least squares quantization in PCM. *IEEE Transactions on Information Theory* 28, 2 (March 1982), 129-137) may be used to discover clusters in the dataset. Clusters may be generated according to the set of modalities that are regarded as body shape information: height, shoulder circumference, and weight; this information can be easily estimated or regressed using the depth sensor. The number of clusters to use and regulate the quality of the clusters may be defined by empirically minimizing the mean-squared Euclidean distances, between cluster centers and members, resulting in K=10. Cohesion is generally observed in the distribution of participant body shape information, which encourages the approach.

Thermal comfort modeling may be performed using the collected and curated data. The thermal comfort modeling task may be posed as a supervised multiclass classification problem, wherein the model estimates the likelihood of having accurately predicted a specific comfort label for an occupant, C=y, conditioned on some context. With the "full" data featureset FS1 (e.g., as shown in Table 3), the context of the model involves Band (B a), Body (Bo), Survey (S), HVAC (H), and Weather (W) data as shown in equation (1):

$$P(C^t=y|Ba,Bo,S,H,W)$$

where, $$y\in\mathcal{Y}\ \{-2,-1,0,1,2\} \tag{1}$$

Thus, a training objective is to minimize the aggregate negative log-likelihood of these predictions, over an arbitrary time horizon, with respect to the corresponding ground-truth comfort labels (as shown in Equation 2):

$$\min \Sigma -\log(P(C^t=y|Ba,Bo,S,H,W)) \tag{2}$$

In machine learning literature, this formulation is also referred to as cross-entropy.

For the model architectural class, a multi-layer perceptron (MLP) may be utilized, as this may be used to flexibly represent and map diverse multimodal input distributions, as discussed in thermal comfort literature (Diana Enescu. 2017. A review of thermal comfort models and indicators for indoor environments. *Renewable and Sustainable Energy Reviews* 79, Supplement C (2017), 1353-1379; Soteris A. Kalogirou. 2000. Applications of artificial neural-networks for energy systems. *Applied Energy* 67, 1 (2000), 17-35; Joyce Kim, Stefano Schiavon, and Gail Brager. 2018. Personal comfort models—A new paradigm in thermal comfort for occupant-centric environmental control. *Building and Environment* 132 (2018), 114-124; and Joyce Kim, Yuxun Zhou, Stefano Schiavon, Paul Raftery, and Gail Brager. 2018. Personal comfort models: predicting individuals' thermal preference using occupant heating and cooling behavior and machine learning. *Building and Environment* 129 (2018), 96-106). At each timestep, the model makes a comfort prediction as a distribution over all the comfort class labels (e.g., as shown in Table 1 b.3). (Notably, time-recurrent neural encoding structures (e.g., LSTMs, GRUs) lend themselves well to these sequential data inputs and may be placed in front of the MLP classifier. However, recurrent models have significantly higher training complexity and may provide best results after using various data-augmentation techniques, e.g., weakly-supervised generative modeling.) The label with the largest probability mass may be selected as the predicted occupant's comfort label, given the input context. An example model configuration includes 4 hidden layers (in, 250, 100, 25, 5, out), tan h activations, an adaptive learning rate with an initialization of 1e-3, batch size of 5, one-hot label-vector representations, Adaptive moment estimation (Adam) as the optimization function (Diederik P Kingma and Jimmy Lei Ba. 2015. Adam: A Method for Stochastic Optimization. *International Conference on Learning Representations* (*ICLR*) 2015 (2015)), and an 80%/20% dataset split with 10-fold cross-validation in the training split.

Temperature set-point generation may be performed using the system. The thermal comfort model takes as input body shape and environmental information and outputs comfort class labels in the set −2, −1, 0, 1, 2. From these labels, a zone temperature set-point may be inferred that maximizes the number of participants in the dataset test split that would report "0" or Comfortable as their subjective response. The test split stratified according to participant includes the subjective comfort responses (and associated environmental and body shape information) for the various participants. For each participant in the test set, a forward-pass through the trained comfort model is performed to infer participant comfort preferences. This yields a distribution over zone temperatures, conditioned on comfort label, from which the temperature range is extracted that maximized the number of "0" votes across the test set. These resultant temperature set-points may be compared with set-points generated by baseline control strategies.

A paired dataset of comfort profiles and physical characteristics may be generated from the participants in a commercial building environment. Using this data, an evaluation of common modeling strategies (Diana Enescu. 2017. A review of thermal comfort models and indicators for indoor environments. *Renewable and Sustainable Energy Reviews* 79, Supplement C (2017), 1353-1379; and Soteris A. Kalogirou. 2000. Applications of artificial neural-networks for energy systems. *Applied Energy* 67, 1 (2000), 17-35) for empirical thermal comfort prediction may be performed. Additionally, it may be observed how powerful physical characteristics are for estimating the thermal comfort preferences of occupants. The models may be compared to baselines and ablations.

Regarding body shape inference performance, the performance of the system 100 in terms of its ability to estimate human height and shoulder circumference may be identified. This performance may include height estimation performance, and shoulder circumference estimation performance.

With respect to height estimation performance, Table 4 shows the performance of the system for estimating human height: the average and median error is 3.28 cm and 3.0 cm, respectively, when someone is entering. The average and median error is respectively 2.99 cm and 2.55 cm, when a person is exiting. Considering the mean and median height of our subjects are 171.25 cm and 171 cm, respectively, the height estimation as shown has an accuracy of 98%.

TABLE 4

Body Shape Inference Performance

| | Direction | Average Error | Median Error |
|---|---|---|---|
| Height | Entering | 3.28 cm | 3.0 cm |
| | Exiting | 2.99 cm | 2.55 cm |
| Shoulder | Entering | 9.96 cm | 8.19 cm |
| Circumference | Exiting | 10.03 cm | 9.82 cm |

With respect to shoulder circumference estimation performance, Table 4 also shows the system performance for estimating human shoulder circumference. 40% of the data may be used to fit the linear regression model and the remaining 60% may be used as test data. (However, these are only examples and different data splits may be used.) The average and median errors for a person entering is 9.96 cm and 8.19 cm; the average and median errors for a person exiting is 10.03 cm and 9.82 cm. Considering the mean and median shoulder circumference of the participants are 109.44 cm and 107.15 cm, respectively, this shoulder circumference estimation is over 90% accurate.

Thermal comfort modeling performance may also be estimated. The system may be evaluated in terms of its thermal comfort inference capability. To remain grounded in the related literature (Diana Enescu. 2017. A review of thermal comfort models and indicators for indoor environments. *Renewable and Sustainable Energy Reviews* 79, Supplement C (2017), 1353-1379; Ali Ghahramani, Chao Tang, and Burcin Becerik-Gerber. 2015. An online learning approach for quantifying personalized thermal comfort via adaptive stochastic modeling. *Building and Environment* 92 (2015), 86-96; Joyce Kim, Stefano Schiavon, and Gail Brager. 2018. Personal comfort models—A new paradigm in thermal comfort for occupant-centric environmental control. *Building and Environment* 132 (2018), 114-124; and Joyce Kim, Yuxun Zhou, Stefano Schiavon, Paul Raftery, and Gail Brager. 2018. Personal comfort models: predicting individuals' thermal preference using occupant heating and cooling behavior and machine learning. *Building and Environment* 129 (2018), 96-106), the model may be evaluated across three dimensions: (i) holistic versus personalized comfort models; (ii) binary versus multi-class classification; and (iii) model ablations using different modality subsets. Throughout each of these experiments, the evaluative datasets that are generated from our human comfort experiment may be considered. For instance, with reference to Table 3, these may include: FS1 (all features), FS2 (all features, minus body shape information), FS3 (environmental features and body shape information), FS4 (environmental features only), and FS5 (zone temperature only). The effect of specific feature groups, e.g., body shape information, for providing models with improved inferential capability may also be considered.

Regarding baselines, the datasets FS1-FS5 may be used to compare the model configuration with discriminative classifiers, such as Random Decision Forest (RDF) and Support Vector Machines (SVM). Other classifiers may be included, such as the non-parametric K-Nearest Neighbors (k-NN) classifier, the naive Bayes (NB) classifier, the predicted personal vote (PPV) model proposed by (Peter Xiang Gao and S. Keshav. 2013. SPOT: A Smart Personalized Office Thermal Control System. In *Proceedings of the Fourth International Conference on Future Energy Systems* (*e-Energy* '13). ACM, New York, N.Y., USA, 237-246), and the predicted mean vote (PMV) model (Poul O. Fanger. 1967. Calculation of thermal comfort, Introduction of a basic comfort equation. *ASHRAE transactions* 73, 2 (1967), 111-4), which remains the baseline for comfort-aware commercial building control (American Society of Heating Refrigerating and Air-Conditioning Engineers. Standards Committee. 2013. Thermal environmental conditions for human occupancy. *ASHRAE standard;* 55-2013 2013, STANDARD 55 (2013), 1-44.). For all classifier baselines, a hyperparameter grid search may be performed with respect to the training set, with choice of parameters for each baseline as those of the model that performed with the highest average 10-fold cross-validation f1-micro score.

Models may be holistic models or personalized models. Models that are trained on the entire population's thermal comfort data may be referred to as holistic comfort models. Models trained only on individual participants' thermal comfort data may be referred to as personalized models.

Using a holistic model, the comfort responses of one participant are not distinguished from the responses of another participant. Instead, the models may be stratified across all participant data within the train and validation split, such that samples from the same participant may not exist across the train and validation split. This holistic model configuration illustrates a crowd-level thermal comfort prediction strategy, where individual biases are disregarded and optimization is instead performed across the entire population.

Figure 8B:
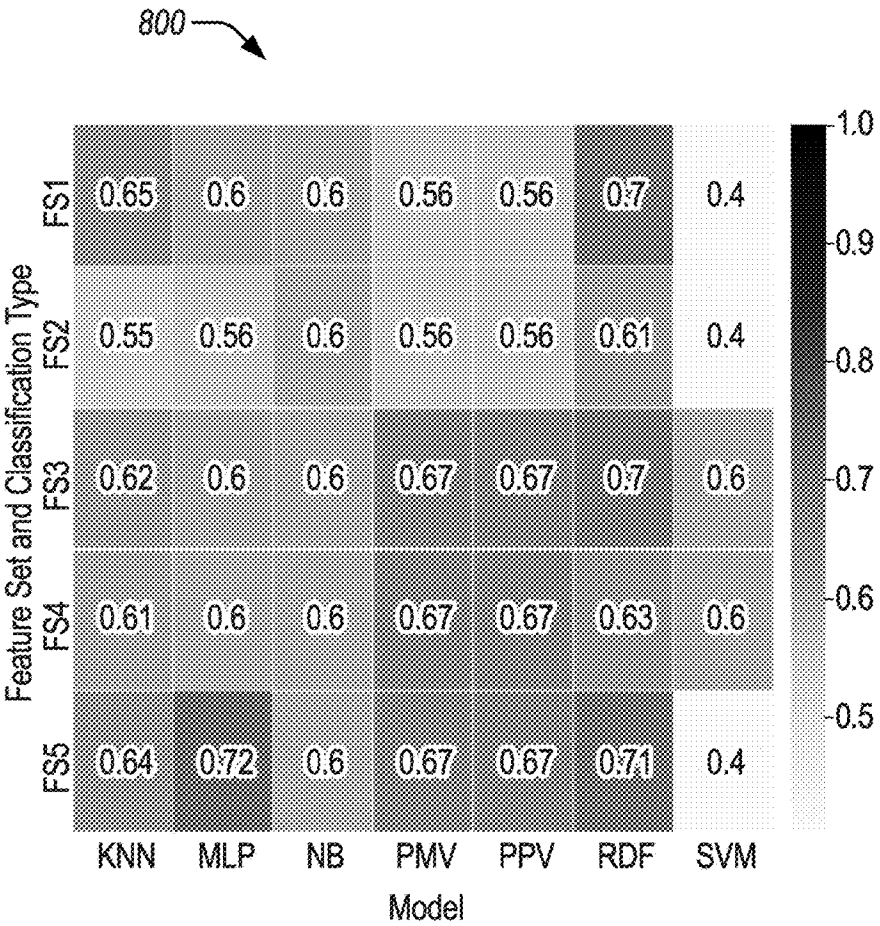
FIGS. 8A and 8B shows approach f1-micro results on the test set for a combination of different models.
Figure 8A:
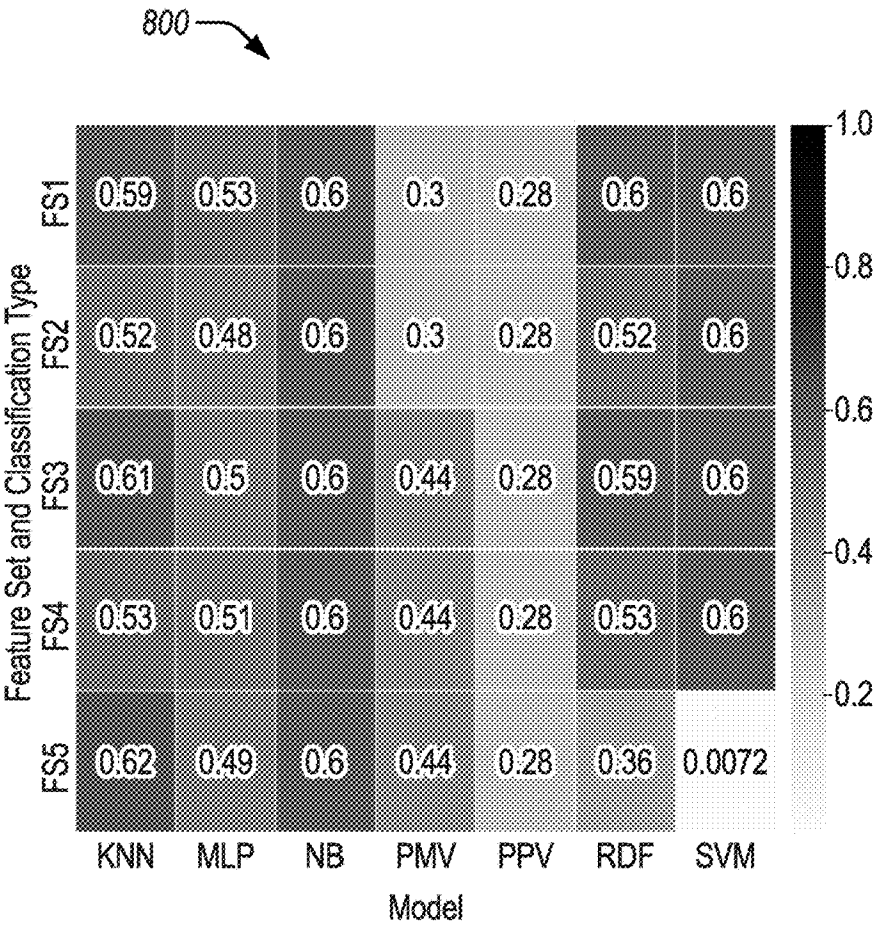

FIG. 8 shows approach f1-micro results on the test set for a combination of different models with features sets for both multi-class (a) and binary target featuresets (b). As shown, the value in each tile represents the f1-micro score of a given model (X-axis), using a specific featureset (Y-axis). For instance, in the case of thermal comfort as a multi-class problem (a), an 6% increase in accuracy (f1-micro score) from using only environmental features (FS3) and environmental and physiological features (FS1).

Figure 9:
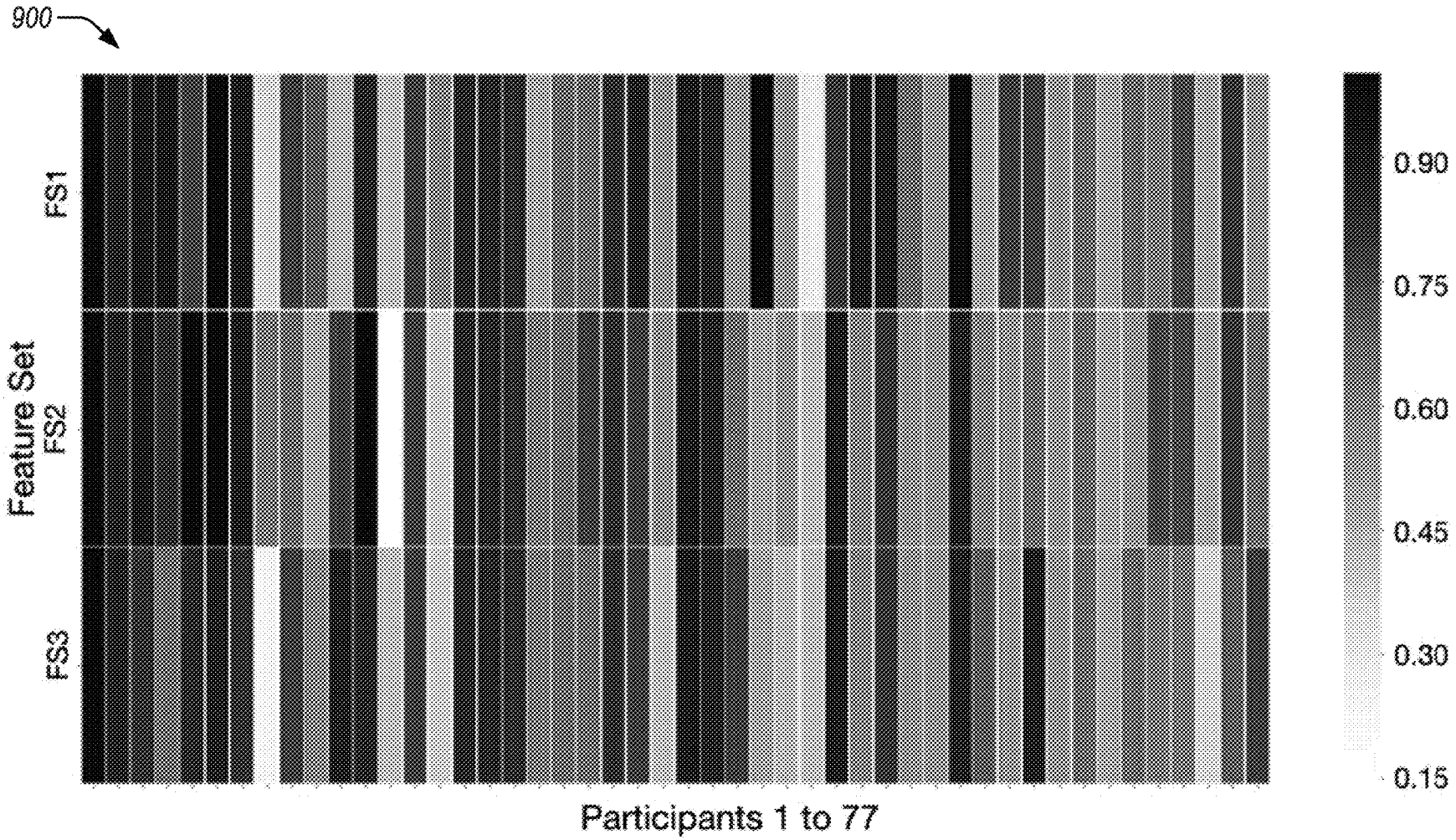
FIG. 9 shows personalized approach f1-micro results on the test set.

FIG. 9 shows personalized approach f1-micro results on the test set of Random Forest for a multi-class target feature on the first three FS. The model parameters were optimized for each subject based on train/test split, resulting in better performance for a subset of subjects. This is reflected in the different colors (variance in the performance metrics) across the X-axis.

Through this evaluation, it may be observed how the same model performs differently for each participant. In particular, it can be seen that the tiles can completely change their color over the horizontal axis. However, even as the number of features used (Y-axis) is increased, the performance for each subset is generally consistent. This implies that the same personalized model configuration is able to capture each participant's unique set of preferences. Moreover, it can be seen that the highest performance achieved in the holistic approach is surpassed by around 20% of the participants that use the same model in a personalized fashion. This seems consistent with the results obtained by, e.g., Barrios and Kleiminger (L. Barrios and W. Kleiminger. 2017. The Comfstat-automatically sensing thermal comfort for smart thermostats. In 2017 *IEEE International Conference on Pervasive Computing and Communications* (*PerCom*). 257-266.) who were able to achieve similar performance for their personalized models on a smaller cohort.

Regarding binary vs. multi-class classifiers, in order to provide binary classifiers for baseline comparison, map the target labels may be re-mapped in each featureset from the 5-class categorical distribution to a binary one, with the label "0" representing Comfortable and any label in $\{-2, -1, 1, 1\}$ representing "1" or Uncomfortable.

FIG. 8(*b*) shows the binary prediction f1-micro scores for the various classifiers. Naturally, binary characterization reduces the representational burden on the models, as they only have to learn to distinguish between two effective distributions. However, such coarse-grained predictions may not be immediately suitable for temperature set-point inference, online (and reinforcement) learning, comfort-aware control, or other downstream tasks.

FIG. 8(*a*) shows model results for multi-class classification. For the multi-class classification problem, RDF models had for FS1: Balanced class weights, Gini Index criterion, 2 minimum sample split, 100 estimators, and tree depth of 10; FS2: changed to 1000 estimators; FS3: changed to entropy criterion, and 100 estimators; FS4: changed to balanced subsamples, 100 estimators; and FS5: changed to 1000 estimators, Gini criterion, and depth of 12. k-NN models had for FS1: brute-force search as algorithm, standard Euclidean distance as metric and K=14; for FS2: K changed to 5; for FS3: K changed to 13; for FS4: K changed to 4; and for FS5 K changed to 15. SVM models had for all first four FS: C=1000, balanced class weight, gamma of 0.1, radial basis function kernel, and one-versus-all decision function shape, with the exception that C=1 and gamma of 0.001 for FS5. Naive Bayes models were initialized without priors with a variational smoothing of 10e-9. The MLP architecture has been discussed above. It can be seen that SVMs and NB have the highest accuracies followed closely by k-NN.

Regarding ablations, a model ablation experiment may be performed by first generating several instances of the comfort model, then feeding each instance with a unique featureset (Table 3), during training and evaluation. From FIGS. 8 and 9, it can be observed the effect of the ablation experiments, where supervised classification models show improvements when adding features related to body shape information, i.e., the tile value increases over the Y-axis. FS1 (all features) improves over FS2 (all features, minus body shape information) by 8%, illustrating the importance of conditioning a thermal comfort predictions of the model on body shape information. It can also be observed that RDF drops significantly with F5. This underperformance could be attributed to the overlapping of Zone Temperature, only feature in F5, for all comfort labels. This low-dimensional input with significant temporal interdependencies that the rest of models are flexible enough to capture, unlike RDF.

Optimal temperature set-points may be found using the aforementioned predictive capabilities. In order to validate the system accuracy in temperature set-point prediction, the comfort prediction capability of the system may be compared with other common fixed temperature control strategies used in practice and in existing literature. These strategies include a fixed temperature set-point range that mimics the current control strategy commercial buildings use, a fixed temperature set-point baseline used in (Alimohammad Rabbani and S. Keshav. 2016. The SPOT* Personal Thermal Comfort System. In *Proceedings of the 3rd ACM International Conference on Systems for Energy-Efficient Built Environments* (*BuildSys* '16). ACM, New York, N.Y., USA, 75-84) and (Peter Xiang Gao and S. Keshav. 2013. Optimal Personal Comfort Management Using SPOT+. In *Proceedings of the 5th ACM Workshop on Embedded Systems For Energy-Efficient Buildings* (*BuildSys* '13). ACM, New York, N.Y., USA, Article 22, 8 pages), a reactive set-point model PPV from (Peter Xiang Gao and S. Keshav. 2013. SPOT: A Smart Personalized Office Thermal Control System. In *Proceedings of the Fourth International Conference on Future Energy Systems* (*e-Energy* '13). ACM, New York, N.Y., USA, 237-246), and two fixed temperature models based on the mean and median temperatures of the validation split. For these baselines, models such as OccuTherm and PPV that require parameter tuning based on existent data may be trained on a 40/60 train-validation split based on the number of participants for both FS1 and FS3. In order to create a range of temperature that each model perceives as a range where comfortable labels are always produced, the fixed set-point models were treated as their set-point ±2° F., whereas in the other models this range was obtained from the training split. The PPV used the minimum and maximum temperature at which the training samples predicted [−0.5, 0.5]. On the other hand, the system comfortable temperature range was calculated from the temperatures at which the 'Comfortable' label was 0. For each model it was calculated the RMSE across the participants' responses in the validation split. Only responses at which the indoor temperature was within the model's 'Comfortable' temperature range were used as shown in equation (3):

$$RMSE = \sqrt{\frac{1}{n}\sum_{i=1}^{n}(0-y)^2} \tag{3}$$

The equation above shows the respective calculation where the 'predicted' label is treated as 0 for all models since it is only considering instances in their respective 'Comfortable' temperature range. y is the ground truth label from the participant. These results, in terms of RMSE, are summarized in Table 5:

TABLE 5

Baseline Comparison

| Models | RMSE FS1 | RMSE FS3 |
|---|---|---|
| OccuThermMLP | 0.56 | 0.73 |
| OccuThermRDF | 0.65 | 0.65 |
| SPOT/SPOT+ | 0.66 | 0.66 |
| OccuThermSVM | 0.68 | 0.68 |
| OccuThermNB | 0.68 | 0.68 |
| PPV [−0.5 \| 0.5] | 0.73 | 0.73 |
| Median Set Point | 0.79 | 0.79 |
| OccuThermKNN | 0.80 | 0.64 |
| Mean Set Point | 0.81 | 0.81 |
| Measured Building Set Point | 0.82 | 0.82 |

Here, it can be seen that, when using a feature set that include body shape information, such as FS1 and FS3, MLP, RDF, and KNN are able to surpass existing control strategies by 0.26 and 0.18, in FS1 and FS3, respectively.

Though the sample size of a human subject study used in the modeling (77 participants) is significantly larger than many other thermal comfort studies in the literature, it is nevertheless small for making claims about the population (e.g., commercial building occupants in the US). Despite this, these results indicate that the system can estimate body shape information with high accuracy and, more importantly, can leverage this information to significantly improve thermal comfort preference predictions when compared to baselines and feature ablations. Though this improvement may seem modest, it is worth noting that the system works without the need for frequent user comfort feedback reports and that it leverages data from depth-imaging sensors, which are quickly becoming commonplace in indoor environments. Furthermore, this is the first demonstration of the predictive power of body shape information for inferring thermal comfort.

The system uses a 5-point comfort scale, rather than the 3-point comfort and 7-point sensation scale proposed by Fanger (American Society of Heating Refrigerating and Air-Conditioning Engineers. Standards Committee. 2013. Thermal environmental conditions for human occupancy. *ASHRAE standard;* 55-2013 2013, STANDARD 55 (2013), 1-44; and Poul O. Fanger. 1967. Calculation of thermal comfort, Introduction of a basic comfort equation. *ASHRAE transactions* 73, 2 (1967), 111-4). Though a systematic analysis of this decision is outside of the scope of this disclosure, it should be noted that there is a robust literature dating back several decades regarding the trade-offs made when using any particular scale, due to numerous issues including effects on participant's behavior and responses, ability to differentiate results, etc. Ultimately, the number of choices presented to study participants (which resembles issues in discrete-choice experiments) should be chosen wisely and could be studied with more care in future work. Finally, the train-validation split by participant had an impact on the model's performance. When a complete stratification of the dataset was done first and then split into train and validation, the system k-NN was able to achieve 79% and 72% accuracy in the binary and multi-class approach. However, this approach allows the co-existence of samples from the same participant in both splits, exposing the model to a portion of the participant's responses distribution; such a setting could be preferable for re-occurring participants. Thus, it was opted for the split based on participants.

In this disclosure a scale was used in order to measure weight of the subjects, which was used as a feature to infer thermal comfort; in the future, a model can be built using body shape to regress weights of individuals. Clothing insulation was also noted in the dataset: in the future, depth frames can be directly used to infer level of clothing insulation. Note that inaccuracies in the estimation of shoulder circumference could affect the performance of thermal comfort inference. People may carry objects, e.g., backpacks, laptops, helmets hanging in the shoulder that could affect the estimation of shoulder circumference. It may require detection of such objects as in (Niluthpol Chowdhury Mithun, Sirajum Munir, Karen Guo, and Charles Shelton. 2018. ODDS: real-time object detection using depth sensors on embedded GPUs. In *Proceedings of the 17th ACM/IEEE International Conference on Information Processing in Sensor Networks*. IEEE Press, 230-241) and refine the shoulder estimate.

The size of the participant group may not be large enough to capture all possible factors (e.g., social, environmental) that could impact the thermal comfort preference of individuals and the resultant commercial building control strategies (J. Francis, A. Oltramari, S. Munir, C. Shelton, and A. Rowe. 2017. Poster Abstract: Context Intelligence in Pervasive Environments. In 2017 *IEEE/ACM Second International Conference on Internet-of-Things Design and Implementation* (*IoTDI*). 315-316; and Z. Jiang, J. Francis, A. K. Sahu, S. Munir, C. Shelton, A. Rowe, and M. Bergés. 2018. Data-driven Thermal Model Inference with ARMAX, in Smart Environments, based on Normalized Mutual Information. In 2018 *Annual American Control Conference* (*ACC*). 4634-4639. https://doi.org/10.23919/ACC.2018.8431085). However, it has been shown that heat dissipation rate of individuals depends on the body surface area. As a result, a tall and skinny person can tolerate higher room temperature compared to a person having a rounded body shape since the tall person has a larger surface to volume ratio (S. V. Szokolay. 2008. Introduction to Architectural Science. Taylor & Francis). So, it is intuitive to assume that body shape can be useful to infer thermal comfort preference of individuals to some extent.

In conclusion, a novel thermal comfort prediction system is presented, based on occupant body shape information. A human thermal comfort study may be conducted in a fully-controlled and fully-sensed smart environment, where biometrics, physical measurements (height, shoulder circumference), and subjective comfort responses were recorded and integrated. With this dataset, holistic comfort models may be compared with personalized comfort models to show the significance of physical characteristics across a sample population for thermal comfort modeling. While holistic approaches can achieve f1-micro scores as high as 0.8, personalized models can surpass this value. Nevertheless, as shown in FIG. 9, even if the models are trained for a particular user, it may not perform as well for others. Finally, though the system is described herein as an inference system, there is significant potential for including it in a closed-loop control scenario, where online learning may be performed to elicit thermal comfort responses opportunistically in order to improve the models.

Figure 10:
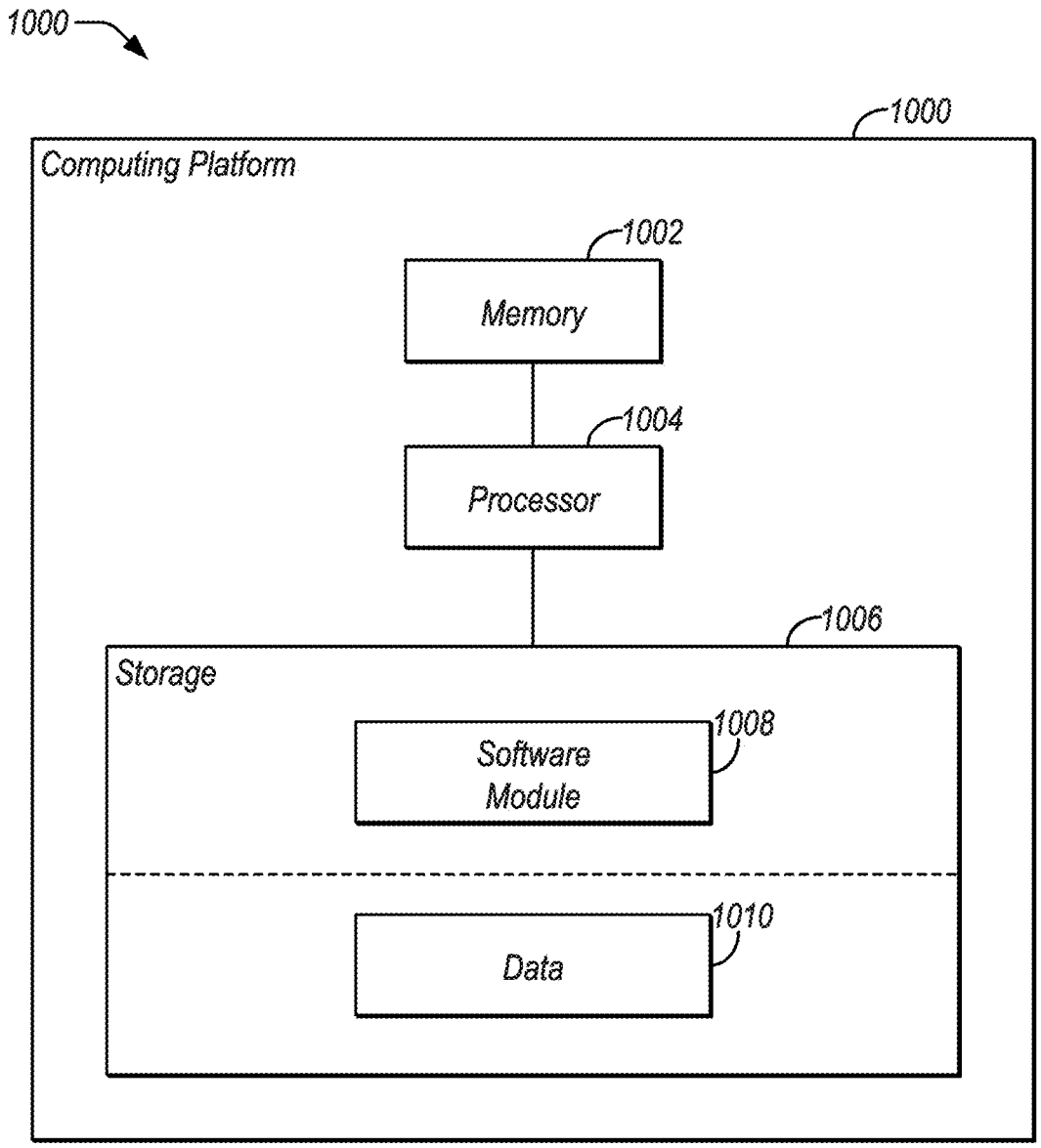
FIG. 10 illustrates an example system for the using body shape information alone or in combination with other information to infer and improve occupant thermal comfort.

FIG. 10 illustrates an example system 1000 for the using body shape information alone or in combination with other information to infer and improve occupant thermal comfort. As discussed in detail herein, described approaches may be used to predict a commercial building occupant's thermal comfort, based on body shape information and relevant environmental factors. The system may perform body shape inference, thermal comfort modeling, and temperature setpoint generation. As discussed herein, the occupant body shape information that is considered is information that can be easily estimated or regressed from depth-camera sensor data. In many examples, this data includes one or more of: height, weight, and shoulder circumference.

The algorithms and/or methodologies of one or more embodiments are implemented using a computing platform, as shown in FIG. 10. The system 1000 may include memory 1002, processor 1004, and non-volatile storage 1006. The processor 1004 may include one or more devices selected from high-performance computing (HPC) systems including high-performance cores, microprocessors, micro-controllers, digital signal processors, microcomputers, central processing units, field programmable gate arrays, programmable logic devices, state machines, logic circuits, analog circuits, digital circuits, or any other devices that manipulate signals (analog or digital) based on computer-executable instructions residing in memory 1002. The memory 1002 may include a single memory device or a number of memory devices including, but not limited to, random access memory (RAM), volatile memory, non-volatile memory, static random access memory (SRAM), dynamic random access memory (DRAM), flash memory, cache memory, or any other device capable of storing information. The non-volatile storage 1006 may include one or more persistent data storage devices such as a hard drive, optical drive, tape drive, non-volatile solid state device, cloud storage or any other device capable of persistently storing information.

The processor 1004 may be configured to read into memory 1002 and execute computer-executable instructions residing in software module 1008 of the non-volatile storage 1006 and embodying algorithms and/or methodologies of one or more embodiments. The software module 1008 may include operating systems and applications. The software module 1008 may be compiled or interpreted from computer programs created using a variety of programming languages and/or technologies, including, without limitation, and either alone or in combination, Java, C, C++, C #, Objective C, Fortran, Pascal, Java Script, Python, Perl, and PL/SQL. In one embodiment, PyTorch, which is a package for the Python programming language, may be used to implement code for the machine learning model of one or more embodiments.

Upon execution by the processor 1004, the computer-executable instructions of the software module 1008 may cause the system 1000 to implement one or more of the algorithms and/or methodologies disclosed herein. The non-volatile storage 1006 may also include data 1010 supporting the functions, features, and processes of the one or more embodiments described herein.

Figure 11:
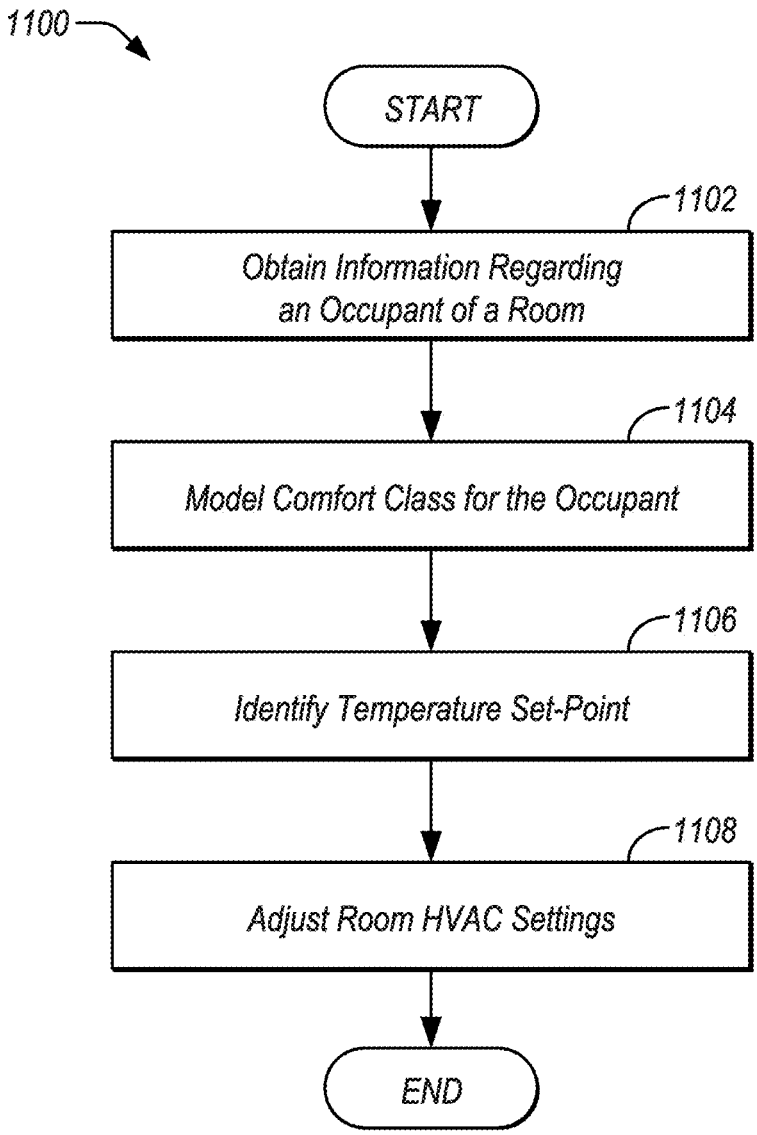
FIG. 11 illustrates an example process for the using body shape information alone or in combination with other information to infer and improve occupant thermal comfort.

FIG. 11 illustrates an example process 1100 for the using body shape information alone or in combination with other information to infer and improve occupant thermal comfort. In an example, the process 1100 may be performed using the system 1000, as described in detail above.

At operation 1102, the system 1100 obtains information regarding an occupant of a room. For instance, responsive to detecting the occupant entered the room, the system 1100 obtains the height, weight, and shoulder circumference of the occupant using a depth sensor mounted to a ceiling of the room.

At operation 1104, the system 1100 models a comfort class for the occupant. For instance, the system 100 utilizes a model trained on a dataset including information reflecting of occupant comfort within the room versus temperature, the model receiving, as inputs, the height, the weight, and the shoulder circumference of the occupant and environmental information and outputting the comfort class.

At operation 1106, the system 1100 identifies a temperature set-point. For instance, the system 1100 identifies the temperature set-point for which the room occupant is identified by the model as having a comfort class indicative of user comfort.

At operation 1108, the system 1100 adjusts room HVAC settings. For instance, the system 1100 adjusts the HVAC controls for the room to the identified temperature set-point. After operation 1108, the process 1100 ends.

The program code embodying the algorithms and/or methodologies described herein is capable of being individually or collectively distributed as a program product in a variety of different forms. The program code may be distributed using a computer readable storage medium having computer readable program instructions thereon for causing a processor to carry out aspects of one or more embodiments. Computer readable storage media, which is inherently non-transitory, may include volatile and non-volatile, and removable and non-removable tangible media implemented in any method or technology for storage of information, such as computer-readable instructions, data structures, program modules, or other data. Computer readable storage media may further include RAM, ROM, erasable programmable read-only memory (EPROM), electrically erasable programmable read-only memory (EEPROM), flash memory or other solid state memory technology, portable compact disc read-only memory (CD-ROM), or other optical storage, magnetic cassettes, magnetic tape, magnetic disk storage or other magnetic storage devices, or any other medium that can be used to store the desired information and which can be read by a computer. Computer readable program instructions may be downloaded to a computer, another type of programmable data processing apparatus, or another device from a computer readable storage medium or to an external computer or external storage device via a network.

Computer readable program instructions stored in a computer readable medium may be used to direct a computer, other types of programmable data processing apparatus, or other devices to function in a particular manner, such that the instructions stored in the computer readable medium produce an article of manufacture including instructions that implement the functions, acts, and/or operations specified in the flowcharts or diagrams. In certain alternative embodiments, the functions, acts, and/or operations specified in the flowcharts and diagrams may be re-ordered, processed serially, and/or processed concurrently consistent with one or more embodiments. Moreover, any of the flowcharts and/or diagrams may include more or fewer nodes or blocks than those illustrated consistent with one or more embodiments.

The processes, methods, or algorithms disclosed herein can be deliverable to/implemented by a processing device, controller, or computer, which can include any existing programmable electronic control unit or dedicated electronic control unit. Similarly, the processes, methods, or algorithms can be stored as data and instructions executable by a controller or computer in many forms including, but not limited to, information permanently stored on non-writable storage media such as ROM devices and information alterably stored on writeable storage media such as floppy disks, magnetic tapes, CDs, RAM devices, and other magnetic and optical media. The processes, methods, or algorithms can also be implemented in a software executable object. Alternatively, the processes, methods, or algorithms can be embodied in whole or in part using suitable hardware components, such as Application Specific Integrated Circuits (ASICs), Field-Programmable Gate Arrays (FPGAs), state machines, controllers or other hardware components or devices, or a combination of hardware, software and firmware components.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A method for inferring and improving occupant thermal comfort accounting for body shape information, comprising:

obtaining height, weight, and shoulder circumference of an occupant of a room using a depth sensor;

utilizing a model trained on a dataset including information reflective of occupant comfort for a set of test occupants with respect to temperature within the room based on factors including temperature of the room and height, weight, and shoulder circumference of the test occupants, the model receiving, as inputs, the height, the weight, and the shoulder circumference of the occupant and environmental information and outputting a comfort class, the comfort class indicating one of a set of comfort indexes, the comfort indexes including a first value indicative of user comfort and one or more other values indicative that the occupant is not comfortable;

identifying a temperature set-point for which the room occupant is identified by the model as having the comfort class indicative of user comfort; and adjusting heating, ventilation, and air conditioning (HVAC) controls for the room to the identified temperature set-point.

2. The method of claim 1, further comprising determining the height by:

discarding all the depth pixels below a threshold to locate a head of the occupant;

fitting an enclosing circle around the head; and estimating the height of the occupant according to a difference between a distance from the depth sensor of a bin with a highest number of pixels indicative of the floor distance, and a pixel within the enclosing circle closest to the depth sensor.

3. The method of claim 1, further comprising determining the shoulder circumference by:

using a region of interest that includes a head of the occupant and a shoulder region of the occupant of three times the diameter of head to locate a shoulder of the occupant; and fitting an ellipse contour around the region to determine the circumference of the shoulder.

4. The method of claim 1, wherein the weight information is determined using a scale.

5. The method of claim 1, wherein the depth sensor is mounted to a ceiling of the room, and further comprising obtaining the height and shoulder circumference of the occupant responsive to detecting the occupant entering the room.

6. The method of claim 1, wherein the information reflective of occupant comfort includes biometric data tracked from wearable devices, the biometrics including one or more of skin temperature, heart rate, and galvanic skin response.

7. The method of claim 1, wherein the information reflective of occupant comfort includes data entered by participants in the room to a user interface, the data including information indicative of comfort level of the participant indexed to temperature of the room.

8. The method of claim 1, further comprising training the model using data including environmental sensor information, occupant physical characteristics, occupant biometrics, and mobile application survey information.

9. A system for inferring and improving occupant thermal comfort accounting for body shape information, comprising:

a memory storing instructions; and a processor programmed to execute the instructions to perform operations including to responsive to detecting an occupant entering a room, obtain height, weight, and shoulder circumference of the occupant of the room using a depth sensor mounted to a ceiling of the room;

utilize a model trained on a dataset including information reflective of occupant comfort for a set of test occupants with respect to temperature within the room based on factors including temperature of the room and height, weight, and shoulder circumference of the test occupants, the model receiving, as inputs, the height, the weight, and the shoulder circumference of the occupant and environmental information and outputting a comfort class, the comfort class indicating one of a set of comfort indexes, the comfort indexes including a first value indicative of user comfort and one or more other values indicative that the occupant is not comfortable;

identify a temperature set-point for which the room occupant is identified by the model as having the comfort class indicative of user comfort; and adjust HVAC controls for the room to the identified temperature set-point.

10. The system of claim 9, wherein the processor is further programmed to execute the instructions to determine the height, including to:

discard all the depth pixels below a threshold to locate a head of the occupant;

fit an enclosing circle around the head; and estimate the height of the occupant according to a difference between a distance from the depth sensor of a bin with a highest number of pixels indicative of the floor distance, and a pixel within the enclosing circle closest to the depth sensor.

11. The system of claim 9, wherein the processor is further programmed to execute the instructions to determine the shoulder circumference, including to:

use a region of interest that includes a head of the occupant and a shoulder region of the occupant of three times the diameter of head to locate a shoulder of the occupant; and fit an ellipse contour around the region to determine the circumference of the shoulder.

12. The system of claim 9, wherein the information reflective of occupant comfort includes biometric data tracked from wearable devices, the biometrics including one or more of skin temperature, heart rate, and galvanic skin response.

13. The system of claim 9, wherein the information reflective of occupant comfort includes data entered by participants in the room to a user interface, the data including information indicative of comfort level of the participant indexed to temperature of the room.

14. The system of claim 9, wherein the processor is further programmed to execute the instructions to train the model using data including environmental sensor information, occupant physical characteristics, occupant biometrics, and mobile application survey information.

15. A non-transitory computer-readable medium comprising instructions for inferring and improving occupant thermal comfort accounting for body shape information that, when executed by a processor, cause the processor to:

responsive to detecting an occupant entering a room, obtain height, weight, and shoulder circumference of the occupant of the room using a depth sensor mounted to a ceiling of the room;

utilize a model trained on a dataset including information reflective of occupant comfort for a set of test occupants with respect to temperature within the room based on factors including temperature of the room and height, weight, and shoulder circumference of the test occupants, the model receiving, as inputs, the height, the weight, and the shoulder circumference of the occupant and environmental information and outputting a comfort class, the comfort class indicating one of a set of comfort indexes, the comfort indexes including a first value indicative of user comfort and one or other values indicative that the occupant is not comfortable;

identify a temperature set-point for which the room occupant is identified by the model as having the comfort class indicative of user comfort; and adjust HVAC controls for the room to the identified temperature set-point.

16. The medium of claim 15, further comprising instructions that, when executed by the processor, cause the processor to determine the height, including to:

discard all the depth pixels below a threshold to locate a head of the occupant;

fit an enclosing circle around the head; and estimate the height of the occupant according to a difference between a distance from the depth sensor of a bin with a highest number of pixels indicative of the floor distance, and a pixel within the enclosing circle closest to the depth sensor.

17. The medium of claim 15, further comprising instructions that, when executed by the processor, cause the processor to determine the shoulder circumference, including to:

use a region of interest that includes a head of the occupant and a shoulder region of the occupant of three times the diameter of head to locate a shoulder of the occupant; and fit an ellipse contour around the region to determine the circumference of the shoulder.

18. The medium of claim 15, wherein the information reflective of occupant comfort includes biometric data tracked from wearable devices, the biometrics including one or more of skin temperature, heart rate, and galvanic skin response.

19. The medium of claim 15, wherein the information reflective of occupant comfort includes data entered by participants in the room to a user interface, the data including information indicative of comfort level of the participant indexed to temperature of the room.

20. The medium of claim 15, further comprising instructions that, when executed by the processor, cause the processor to train the model using data including environmental sensor information, occupant physical characteristics, occupant biometrics, and mobile application survey information.

* * * * *